US008443959B2

(12) United States Patent
Horiguchi et al.

(10) Patent No.: US 8,443,959 B2
(45) Date of Patent: May 21, 2013

(54) COIN PROCESSING APPARATUS

(75) Inventors: Nobushige Horiguchi, Kounosu (JP); Shoichi Uda, Tokyo (JP); Mitsumasa Tsuruda, Kawaguchi (JP); Yasuyuki Nakagawa, Tokyo (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 221 days.

(21) Appl. No.: 12/972,874

(22) Filed: Dec. 20, 2010

(65) Prior Publication Data

US 2011/0151759 A1 Jun. 23, 2011

(30) Foreign Application Priority Data

Dec. 22, 2009 (JP) ..... P2009-290984

(51) Int. Cl.
*G07D 5/00* (2006.01)

(52) U.S. Cl.
USPC ..... 194/302

(58) Field of Classification Search ..... 194/205, 194/217, 302; 209/509, 567; 453/3, 4
See application file for complete search history.

(56) References Cited

U.S. PATENT DOCUMENTS

| | | | | |
|---|---|---|---|---|
| 6,623,349 | B2 | 9/2003 | Fletcher | |
| 2004/0035673 | A1 * | 2/2004 | Hibari | 194/320 |
| 2009/0229949 | A1 * | 9/2009 | Nakamoto | 194/302 |

FOREIGN PATENT DOCUMENTS

| | | | |
|---|---|---|---|
| CN | 1271914 | A | 11/2000 |
| CN | 2884345 | Y | 3/2007 |
| DE | 39 28 908 | A1 | 3/1990 |
| JP | 2001-273543 | | 10/2001 |
| JP | 2008-097099 | | 4/2008 |
| KR | 10-2007-0035423 | | 3/2007 |
| KR | 10-2009-0016397 | | 2/2009 |

OTHER PUBLICATIONS

Extended European Search Report in EP 10 19 5003 dated Apr. 29, 2011.

Notice of Allowance and English translation in KR 10-2010-0129858 mailed May 22, 2012.

The First Office Action and English Translation for Chinese Application No. 201010625257.8, issued Sep. 20, 2012, 15 pages.

* cited by examiner

*Primary Examiner* — Mark Beauchane
(74) *Attorney, Agent, or Firm* — Nixon & Vanderhye, PC

(57) ABSTRACT

A coin processing apparatus according to the present invention includes: a coin conveying section that conveys coins on a coin passage; an identifying section that identifies coins on the coin passage; at least one discharging section that discharges normal coins that are identified as normal by the identifying section from the coin passage; at least first and second removing sections that remove abnormal coins that are identified as abnormal by the identifying section from the coin passage; and a control section that distributes abnormal coins to either one of the first and second removing sections in order to remove the abnormal coins, in accordance with identification factors of the abnormal coins.

14 Claims, 4 Drawing Sheets

COIN PROCESSING APPARATUS

BACKGROUND OF THE INVENTION

1. Field of the Invention

The present invention relates to a coin processing apparatus, and in particular to preventing a drop in the processing efficiency thereof.

Priority is claimed on Japanese Patent Application No. 2009-290984, filed Dec. 22, 2009, the content of which is incorporated herein by reference.

2. Description of Related Art

The coin processing apparatus that is disclosed in Japanese Unexamined Patent Application, First Publication No. 2008-97099 can, upon identifying an abnormal coin, specify this abnormal coin and clarify the identification factor.

A conventional coin processing apparatus has a coin conveying section, an identifying section, a coin stopping section, a display section, and a control section. The coin conveying section conveys coins on a coin passage. The identifying section identifies coins on the coin passage. The coin stopping section stops coins on the coin passage. The display section performs display. When an abnormal coin is identified by the identifying section, the control section causes the abnormal coin to stop by the coin stopping section, and causes a detection image of the abnormal coin to be displayed on the display section when the identification factor of the abnormal coin by the identifying section is a factor related to the detection image. That is, when an abnormal coin has been identified, by performing control that stops that abnormal coin with the coin stopping section, this abnormal coin is specified, and by displaying the detection image of the abnormal coin in the display section when the identification factor of the abnormal coin is a factor related to the detection image, that identification factor is clarified.

However, in performing control that stops the abnormal coin with the coin stopping section in this manner, when identifying a group of coins that includes comparatively many abnormal coins, the number of stoppages increases, and so there has been the possibility of the processing efficiency falling.

SUMMARY OF THE INVENTION

The present invention has as an object to provide a coin processing apparatus that, even when identifying a group of coins that includes comparatively many abnormal coins, can specify the abnormal coins and clarify the identification factor, and can prevent a reduction in the processing efficiency.

A coin processing apparatus according to the present invention includes: a coin conveying section that conveys coins on a coin passage; an identifying section that identifies coins on the coin passage; at least one discharging section that discharges normal coins that are identified as normal by the identifying section from the coin passage; at least first and second removing sections that remove abnormal coins that are identified as abnormal by the identifying section from the coin passage; and a control section that distributes abnormal coins to either one of the first and second removing sections in order to remove the abnormal coins, in accordance with identification factors of the abnormal coins.

With this constitution, the coin processing apparatus includes at least two removing sections, namely, first and second removing sections that remove abnormal coins that are identified as abnormal by the identifying section from the coin passage. When removing abnormal coins, the control section distributes abnormal coins to either one of the first and second removing sections in order to remove the abnormal coins, in accordance with identification factors of the abnormal coins. Therefore, since it is possible to remove abnormal coins by distribution to the separate removing sections in accordance with the identification factor, it is possible to specify the abnormal coins and clarify the identification factor even without stopping the abnormal coins. Therefore, even in the case of identifying a group of coins that includes comparatively many abnormal coins, it is possible to specify the abnormal coins and clarify the identification factor, and possible to prevent a reduction in the processing efficiency.

In the coin processing apparatus, the discharging section may include at least first and second discharging sections, and the first discharging section may be a specified discharging section that discharges coins that are normal coins and of a specified denomination, and the second discharging section may be an unspecified discharging section that discharges coins that are normal coins and other than the coins of the specified denomination.

With this constitution, the first discharging section is a specified discharging section that discharges coins that are normal coins and of a specified denomination, and the second discharging section is an unspecified discharging section that discharges coins that are normal coins and other than the coins of the specified denomination. For that reason, it is possible to separate and discharge coins that are normal coins and of a specified denomination from coins that are normal coins and other than coins of the specified denomination.

In the coin processing apparatus, the specified discharging section may include at least either one of a counting chute for bagging coins that are normal coins and of the specified denomination, and a discharge chute for boxing coins that are normal coins and of the specified denomination.

With this constitution, the specified discharging section includes at least either one of a counting chute for bagging coins that are normal coins and of the specified denomination, and a discharge chute for boxing coins that are normal coins and of the specified denomination. For this reason, it is possible to discharge coins that are normal coins and of a specified denomination in at least one state of bagging or boxing.

The coin processing apparatus may further include a mode setting section that selects either one of at least two operation modes, and the control section may select and set the identification factors of the abnormal coins at the first and second distribution sections, in accordance with the operation mode selected by the mode setting section.

With this constitution, the control section selects and sets the identification factors of the abnormal coins at the first and second distribution sections, in accordance with the operation mode selected by the mode setting section. For this reason, the identification factor of each removing section is decided by selection of the operation mode.

The coin processing apparatus may further include: an identification factor setting section that selects and sets the identification factor of the abnormal coins at each of the first and second removing sections, and the control section may limit an identification factor to be select and set for the first removing section by the identification factor setting section so as not to overlap with an identification factor that has been selected and set for the second removing section.

With this constitution, since the coin processing apparatus includes the identification factor setting section that selects and sets the identification factor of the abnormal coins at each of the first and second removing section, it is possible to arbitrarily set the identification factor at each removing section. Moreover, the control section limits an identification factor to be select and set for the first removing section by the identification factor setting section so as not to overlap with an identification factor that has been selected and set for the second removing section. For that reason, it is possible to prevent the same identification factor being redundantly set for a plurality of removing sections.

The coin processing apparatus may further include: a display section that displays the identification factors for the abnormal coins for each of the first and second removing sections.

With this constitution, the display section displays the identification factors for the abnormal coins for each of the first and second removing sections. For that reason, it is possible to readily allow recognition of the correspondence relationship between the sorting section and the identification factor of an abnormal coin.

DETAILED DESCRIPTION OF THE INVENTION

Figure 1:
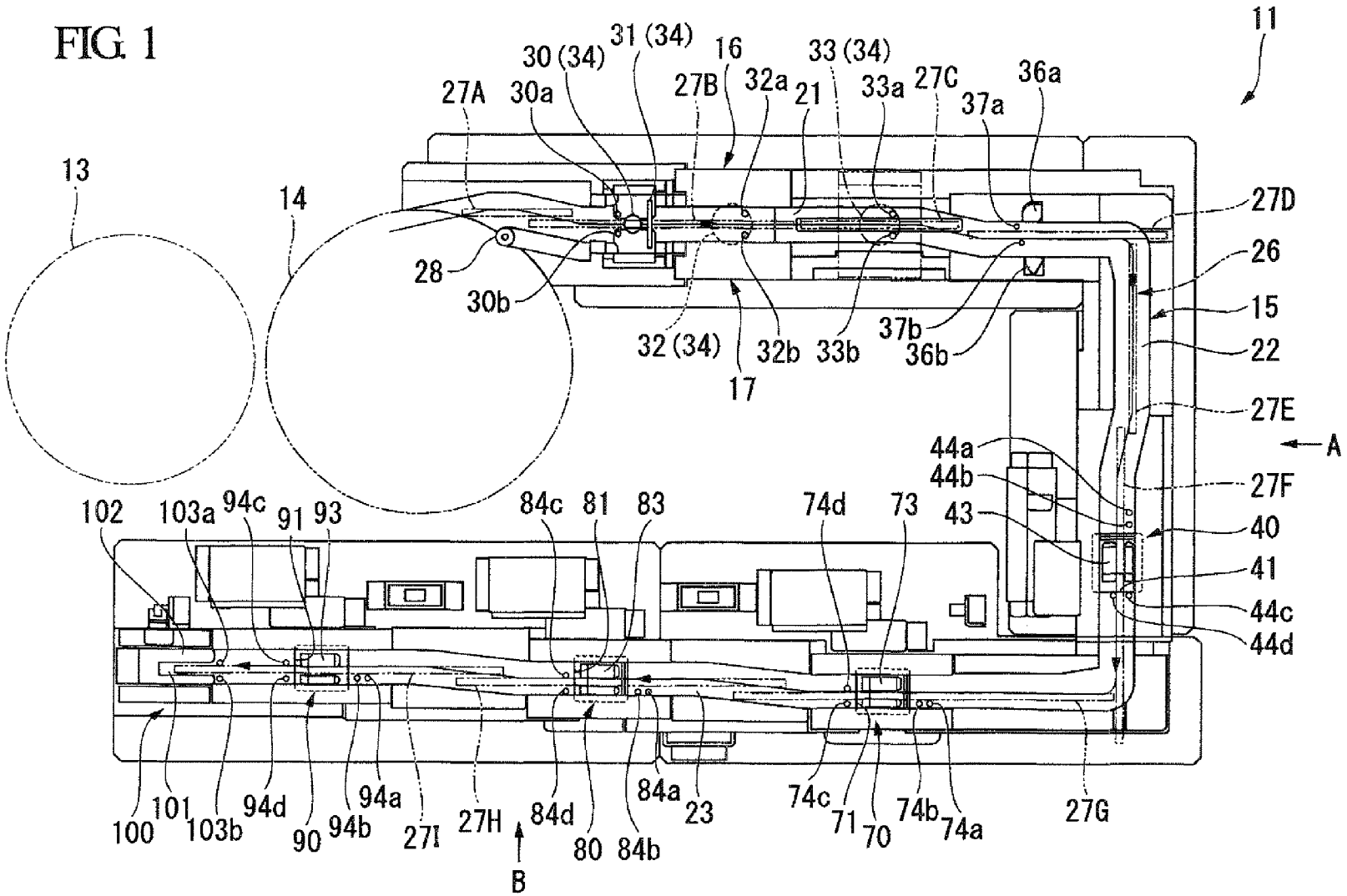
FIG. 1 is a plan view of a main portion of a coin processing apparatus according to one embodiment of the present invention.

The coin processing apparatus according to one embodiment of the present invention shall be explained below with reference to the drawings.

An insertion slot, not illustrated, into which loose coins are inserted by an operator is provided on the upper surface of a coin processing apparatus 11 of the present embodiment. At the upper section of the coin processing apparatus 11, positioned on the lower side of this insertion slot, a supply disk 13 is provided. The supply disk 13 receives the loose coins that have been inserted into the insertion slot, and is rotatable about the vertical axis. A rotating disk 14 is provided adjacent to the side of this supply disk 13, and is rotatable about the vertical axis. This rotating disk 14 receives the loose coins that have been paid out by centrifugal force from the supply disk 13. Along with that, the rotating disk 14, by causing the coins that have been received to pass through a separating section not illustrated by centrifugal force, pays them out one by one to a coin passage 15 for guiding coins described below. The supply disk 13 and the rotating disk 14 are forward and reverse driven by a supply drive section 201 that includes a motor not illustrated that is controlled by a control apparatus (control section) 200 shown in FIG. 2.

As shown in FIG. 1, the coin passage 15 is provided on the upper section of the coin processing apparatus 11. The coin passage 15 guides the coins that have been paid out from the rotating disk 14 on a passage surface between guides 16 and 17 of both sides higher by one step. This coin passage 15 has a first passage section 21, a second passage section 22, and a third passage section 23. The coin passage 15 guide coins that have been paid out from the rotating disk 14 in the order of the first passage section 21, the second passage section 22, and the third passage section 23. The first passage section 21 extends horizontally in an approximately straight line from the rotating disk 14 to the side opposite the supply disk 13. The second passage section 22 bends at an approximately right angle from the side of the first passage section 21 opposite the rotating disk 14 to the side that the rotating disk 14 is disposed, and extends horizontally in an approximately straight line. The third passage section 23 bends at an approximate right angle from the side of the second passage section 22 opposite the first passage section 21 in the direction of the rotating disk 14 and extends horizontally in an approximately straight line.

A coin conveying section 26 that conveys coins on the coin passage 15 is provided in the vicinity of the coin passage 15. This coin conveying section 26 is provided on the upper side of the coin passage 15. The coin conveying section 26 has conveyor belts 27A to 27I that cause the coins that have been paid out from the rotating disk 14 to move along the coin passage 15. That is, the conveyor belts 27A, 27B, 27C, and 27D cause coins to move on the first passage section 21. The conveyor belts 27E and 27F cause coins to move on the second passage section 22. The conveyor belts 27G, 27H, and 27I cause coins to move on the third passage section 23.

Figure 2:
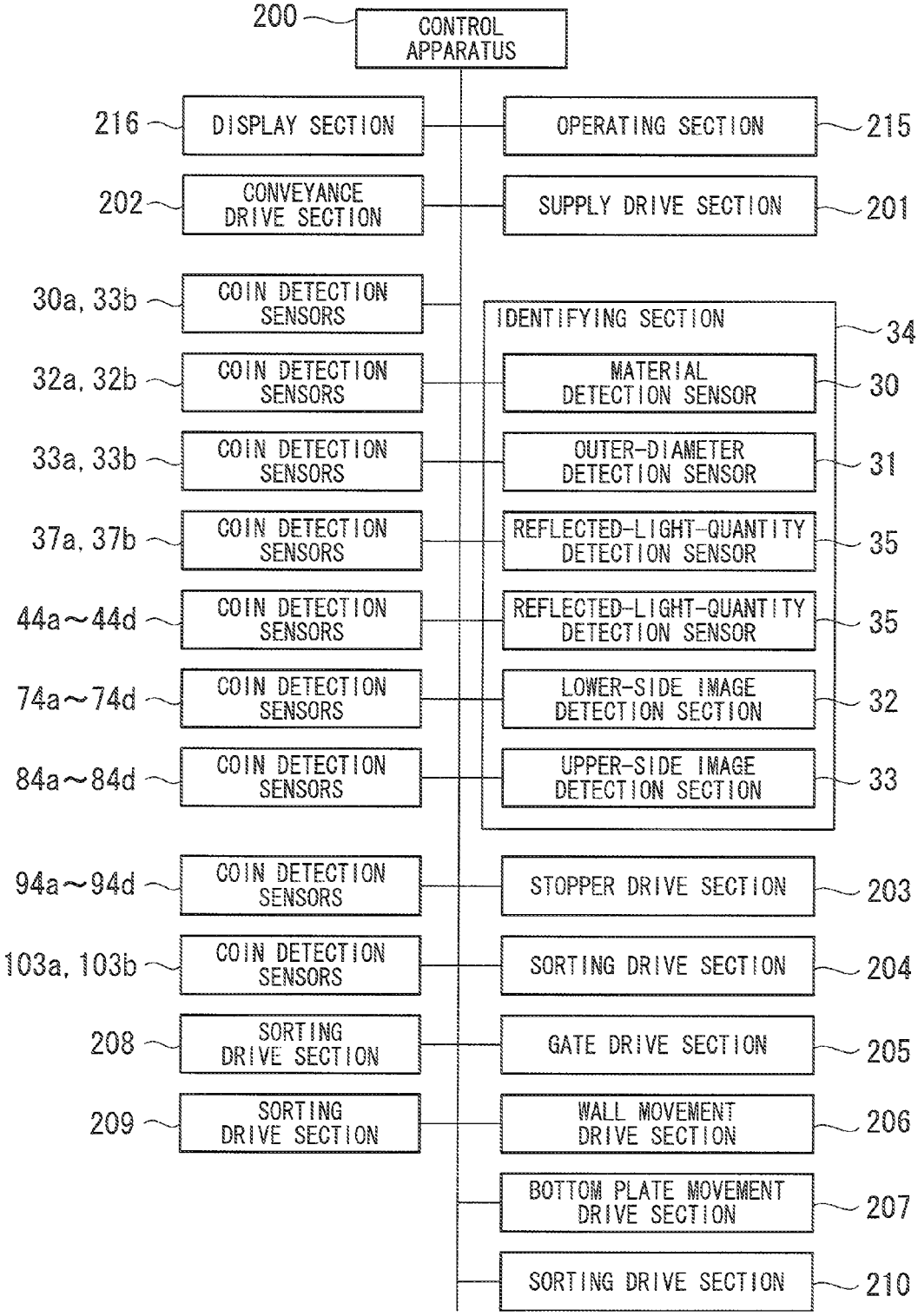
FIG. 2 is a block diagram of a control system of the coin processing apparatus according to the one embodiment of the present invention.

Moreover, the coin conveying section 26 has a conveyance drive section 202 that has a motor, not illustrated, controlled by the control apparatus 200 shown in FIG. 2, and drives in forward and reverse directions in conjunction with the conveyor belts 27A to 27I.

As shown in FIG. 1, a guide roller 28 is provided at the position of the distal end portion of the one guide 17, between the rotating disk 14 and the first passage section 21 of the coin passage 15. The guide roller 28 freely rotates, and causes the coins that collide with the distal end portion of this guide 17 and accumulate to be either returned to the rotating disk 14, or readily guided to the coin passage 15.

A material detection sensor 30 is arranged in the first passage section 21 of the coin passage 15 so as to constitute a portion of the passage surface of the first passage section 21. The material detection sensor 30 detects the material of the coin being conveyed on the first passage section 21 with magnetic data. Coin detection sensors 30*a* and 30*b* are provided in the vicinity of the material detection sensor 30. The coin detection sensors 30*a* and 30*b* measure the timing of retrieving the detection data by this material detection sensor 30. That is, the control apparatus 200 makes the material detection sensor 30 execute retrieval of the detection data based on the timing at which coins are detected by these coin detection sensors 30*a* and 30*b*. An outer-diameter detection sensor 31 is arranged close to the second passage section 22 on the second passage section 22 side, that is, the downstream side, of the material detection sensor 30 of the first passage section 21. The outer-diameter detection sensor 31 includes a line sensor that detects the diameter of a coin being conveyed on the first passage section 21. The outer-diameter detection sensor 31 includes a light receiving section that is arranged so as to constitute a section of the passage surface of the first passage section 21 with an orientation that intersects perpendicularly with the conveying direction of a coin, and a light emitting section that is arranged so as to face this light receiving section. The outer-diameter detection sensor 31 detects the maximum length of the light receiving section that is blocked with one coin crosses as the diameter of the coin. Upper and lower reflected-light-quantity detection sensors 35, 35 are provided in the vicinity of the material detection sensor 30 and the outer-diameter detection sensor 31. The upper and lower reflected-light-quantity detection sensors 35, 35 includes upper and lower light emitting sections that radiate light on the upper and lower sides of the coin, respectively, and upper and lower light receiving sections that detect reflected light from the upper and lower sides of the coin, respectively. Based on the timing at which a coin is detected by the coin detection sensors 30*a* and 30*b*, taking in of the detection data by the reflected-light-quantity detection sensors 35, 35 is executed.

On the downstream side of the material detection sensor 30, the outer-diameter detection sensor 31, and the reflected-light-quantity detection sensors 35, 35 of the first passage section 21, a lower-side image detection section 32 is arranged so as to constitute a portion of the passage surface of the first passage section 21. The lower-side image detection section 32 includes a CCD area sensor or the like, and detects an image of the coin being conveyed in the first passage section 21 from the lower side. Coin detection sensors 32*a* and 32*b* are provided on both sides of the lower-side image detection section 32. The coin detection sensors 32*a* and 32*b* measure the timing of retrieval of the detection data by this lower-side image detection section 32. That is, the control apparatus 200 causes the lower-side image detection section 32 to execute the retrieval of the detection data at the moment when a coin is detected by both of these coin detection sensors 32*a* and 32*b*.

On the downstream side of the lower-side image detection section 32 of the first passage section 21, an upper-side image detection section 33 is arranged so as to face the passage surface of the first passage section 21. The upper-side image detection section 33 includes a CCD area sensor or the like, and detects an image of the coin being conveyed in the first passage section 21 from the upper side. Coin detection sensors 33*a* and 33*b* are provided on both sides of the upper-side image detection section 33. The coin detection sensors 33*a* and 33*b* measure the timing of retrieval of the detection data based by this upper-side image detection section 33. That is, the control apparatus 200 causes the upper-side image detection section 33 to execute the retrieval of the detection data at the moment when a coin is detected by both of these coin detection sensors 33*a* and 33*b*.

By such a configuration, an identifying section 34 that identifies coins on the coin passage 15, and which is constituted by the material detection sensor 30, the outer-diameter detection sensor 31, the reflected-light-quantity detection sensors 35, 35, the lower-side image detection section 32, and the upper-side image detection section 33, is arranged within the range of the first passage section 21 of the coin passage 15.

The outputs of the material detection sensor 30, the outer-diameter detection sensor 31, the reflected-light-quantity detection sensors 35, 35, the lower-side image detection section 32, and the upper-side image detection section 33, which constitute the identifying section 34, are inputted into the control apparatus 200 in sequence. This control apparatus 200 first compares the detection data of the material detection sensor 30 for the detected coin with material reference data for all the types of genuine coins that can be handled. In the case of the control apparatus 200 having determined the material detection data to be of a different material that does not agree by a predetermined degree of coincidence or greater with the material reference data of all the types of genuine coins that can be handled, it determines the detected coin at that moment in time to be a different material false coin with the identification factor being a different material, and thereafter does not perform identification.

When the control apparatus 200, from the detection result of the material detection sensor 30, has determined that there is agreement by a predetermined degree of coincidence or greater with the material reference data of any one type of genuine coin, it then reads out the reference reflected-light-quantity data according to the material of this type of genuine coin. Next, the control apparatus 200 determines whether or not this reference reflected-light-quantity data and the reflected-light-quantity detection data of the front and rear sides of the coin detected by the reflected-light-quantity detection sensors 35, 35 for the same detected coin agree by a predetermined degree of coincidence or greater. That is, if the control apparatus 200 determines that both of the reflected-light-quantity detection data of the front and rear surfaces of the detected coin exceed the reference reflected-light-quantity data according to the material, it judges there to be no contamination/damage on the coin being detected. On the other hand, in the case of determining that at least either one of the reflected-light-quantity detection data of the front and rear surfaces of the detected coin does not exceed the reference reflected-light-quantity data according to the material, the control apparatus 200 judges it as being contaminated/damaged, and determines this detected coin as being a reflection-contaminated/damaged genuine coin with the identification factor being reflection contamination.

When the control apparatus 200, from the detection result of the material detection sensor 30, has determined that there is agreement by a predetermined degree of coincidence or greater with the material reference data of any type of genuine coin, next, it reads out the diameter reference data of this type of genuine coin. Next, the control apparatus 200 determines whether or not this reference data and the diameter detection data detected by the outer-diameter detection sensor 31 for the same coin being detected agree by a predetermined degree of coincidence or greater. In the case of the control apparatus 200 determining that the diameter reference data and the diameter detection data are different diameters that do not agree by a predetermined degree of coincidence or greater, it determines this detected coin to be a different diameter false coin with the identification factor being a different diameter, and thereafter does not perform identification.

When the control apparatus 200 determines that the coin is not a different diameter false coin since the diameter reference data and the diameter detection data agree by a predetermined degree of coincidence or greater from the detection result of the outer-diameter detection sensor 31, it reads image reference pattern data of the front and rear sides of the one type of genuine coin having reference data that agrees with the detection result of the material detection sensor 30 for this detected coin. Next, the control apparatus 200 compares the reference pattern data of these images with the detection pattern data of the lower-side image detection section 32 and the detection pattern data of the upper-side image detection section 33 for the same detection coin, and detects whether or not the respective pattern data of the front and rear sides and the outer diameters agree by a predetermined degree of coincidence or greater. When the control apparatus 200 determines that the reference pattern data and detection pattern data of the respective images of the front and rear sides agree by a predetermined degree of coincidence or greater, and that these outer diameters agree by a predetermined degree of coincidence or greater, it determines this detected coin to be a genuine coin of the one type. On the other hand, when the control apparatus 200 makes the determination of a different image in which the reference pattern data and detection pattern data of at least either one of the images of the front and rear sides do not agree by a predetermined degree of coincidence or greater, or the outer diameters do not agree by a predetermined degree of coincidence or greater, this detected coin is determined to be a different image false coin with the identification factor being a different image.

The description shall be given for the case of identifying coins in which, for all denominations, one side for the same denomination has a common design by all issuing countries, and the opposite side has a design that differs for each issuing country, such as Euro coins. In this case, the control apparatus 200 determines whether or not the design of one side that is common to all the issuing countries agrees by a predetermined degree of coincidence or greater with reference master data that is common to each of the issuing countries. Also, the control apparatus 200 compares the design of the reverse side that differs for each issuing country with reference master data of each respective issuing country and determines whether or not it agrees by a predetermined degree of coincidence or greater. If the common design agrees by a predetermined degree of coincidence or greater with the master data that is common to each of the issuing countries, and the design that differs for each issuing country agrees by a predetermined degree of coincidence or greater with the master data of the design of any one issuing country, the control apparatus 200 identifies it as a genuine coin of that one country, and otherwise determines it to be a different image false coin with the identification factor being a different image.

As described above, for the top and bottom sides, that is, the front and rear sides, of a coin being detected, when the detection pattern data matches the reference pattern data by a predetermined degree of coincidence or greater, and the coin outer diameter of the detection pattern data matches the coin outer diameter of the reference pattern data by a predetermined degree of coincidence or greater, the control apparatus 200 determines it to be a genuine coin with high degrees of coincidence. On the other hand, for either of the top and bottom sides, that is, the front and rear sides, of a coin being detected, when the detection pattern data does not match the reference pattern data by a predetermined degree of coincidence or greater, or when the coin outer diameter of the detection pattern data does not match the coin outer diameter of the reference pattern data by a predetermined degree of coincidence or greater, the control apparatus 200 determines it to be a different image false coin with low degrees of coincidence.

In addition, for a coin being detected that has been determined to be a genuine coin of the one type, the control apparatus 200 compares the degree of coincidence of, for example, the color tone of the detection pattern data with the reference pattern data for the top and bottom sides, that is, the front and rear sides of the coin. In the case of the degree of coincidence of the color tone matching by a predetermined degree of coincidence or greater, the control apparatus 200 determines the degree of contamination to be within an allowable range and therefore normal. On the other hand, in the case of the degree of coincidence of the color tone not matching by a predetermined degree of coincidence or greater, the control apparatus 200 determines the degree of contamination to be not within an allowable range and therefore abnormal, and determines the coin being detected to be a contaminated genuine coin with the identification factor being contamination. In this case, when comparing the degree of coincidence for the color tone, the degree of coincidence over the entire surface of the coin may be compared, or the degree of coincidence of a partial region of the coin surface may be compared.

Moreover, for a coin being detected that has been determined to be a genuine coin as described above, the control apparatus 200 determines whether or not there is a region in which the degree of coincidence of the reference pattern data and the detection pattern data is locally lower than a predetermined ratio for the top and bottom sides, that is, the front and rear sides. In the case of there being no region in which the degree of coincidence is locally lower than a predetermined ratio, the control apparatus 200 determines the degree of damage to be within an allowable range and therefore normal. On the other hand, in the case of there being a region in which the degree of coincidence is locally lower than a predetermined ratio, the control apparatus 200 determines the degree of damage to be not within an allowable range and therefore abnormal, and determines the coin being detected to be a locally damaged genuine coin with the identification factor being local damage.

In addition, for a coin being detected that has been determined to be a genuine coin as described above, the control apparatus 200 detects the degree of deformation (roundness) of the outer diameter portion of the coin from the detection pattern data, for the top and bottom sides, that is, the front and rear sides. When the degree of deformation of the outer diameter portion is less than a predetermined value, the control apparatus 200 determines the degree of deformation to be within an allowable range, and therefore normal. On the other hand, in the case of the degree of deformation being a predetermined value or greater, the control apparatus 200 determines the degree of deformation to be not within an allowable range, and therefore abnormal, and determines the coin being detected to be an overall damaged genuine coin with the identification factor being overall damage.

Among genuine coins, the control apparatus 200 determines a coin that is found to be at least any one of a contaminated coin, a locally damaged genuine coin, and an overall damaged genuine coin to be an image-contaminated/damaged genuine coin with the identification factor being image contamination/damage. Also, for a genuine coin that is determined to be a contaminated/damaged coin by the upper and lower reflected-light-quantity detection sensors 35, 35, even if it is not applicable to at least any one of a contaminated coin, a locally damaged genuine coin, and an overall damaged genuine coin, the control apparatus 200 determines it to be a reflection-contaminated/damaged genuine coin with the identification factor being reflection contamination/damage. Also, the control apparatus 200 determines a coin among genuine coins that is not applicable to an image-contaminated/damaged genuine coin or a reflection-contaminated/damaged genuine coin to be a normal coin. The control apparatus 200 determines coins other than normal coins to all be abnormal coins.

Stopper members 36*a* and 36*b* are provided on both sides of the first passage section 21 downstream of the upper-side image detection section 33, sandwiching the first passage section 21. The stopper members 36*a* and 36*b* abut a coin on the first passage section 21 from the downstream side, and thereby cause it to stop. These stopper members 36*a* and 36*b* are made to rotate forward and reverse by a predetermined angle with a stopper drive section 203 shown in FIG. 2 that includes a rotary solenoid not illustrated.

These stopper members 36*a* and 36*b* firstly function as stoppers for counting at the time of batch capture. When the coins of the required denomination reach the predetermined batch capture number, by the control of the control apparatus 200 both of the stopper members 36*a* and 36*b* simultaneously project into the first passage 21 and block the passage of coins that exceed the predetermined number that have been conveyed by the first passage section 21. Moreover, these stopper members 36*a* and 36*b* secondly function as stoppers for stopping in the case where an abnormality such as a jam occurs. When an abnormality occurs, by the control of the control apparatus 200, both of the stopper members 36*a* and 36*b* simultaneously project into the first passage section 21, abut a coin, and block the passage of the coins thereafter. When the stopper members 36*a* and 36*b* function as stoppers for counting, after causing these stopper members 36*a* and 36*b* to operate, the control apparatus 200 carries out reverse rotation of the conveyor belts 27A to 27D by the coin conveying section 26. As a result, all the coins further upstream than the stopper members 36*a* and 36*b* are returned to the rotating disk 14.

Furthermore, a coin detection sensor 37*a* and a coin detection sensor 37*b* are provided at positions just before the upstream side of the stopper members 36*a* and 36*b* in the first passage section 21. The coin detection sensor 37*a* measures the operation timing of the stopper drive section 203 that drives these stopper members 36*a* and 36*b*. The coin detection sensor 37*b* confirms the stoppage of coins. That is, the control apparatus 200 drives the stopper drive section 203 based on the timing at which a target coin is detected by the coin detection sensor 37*a*, and makes the stopper members 36*a* and 36*b* project into the first passage section 21. As a result, the stopper members 36*a* and 36*b* abut this target coin and cause it to stop. Then, when a coin is detected by the coin detection sensor 37*b*, it will detect that the target coin has stopped.

A first sorting section 40 that is capable of discharging coins from the second passage section 22 is provided on the third passage section 23 side of the second passage section 22. This first sorting section 40 has a sorting hole 41, a sorting guide member 43, and a sorting drive section 204. The sorting hole 41 is formed in the passage surface of the second passage section 22. The sorting guide member 43 is provided at the end portion position of the downstream side in the coin conveying direction of this sorting hole 41, and is capable of rotation centered on a rotating shaft 42 shown in FIG. 3. The sorting drive section 204 is shown in FIG. 2 and includes a rotary solenoid not illustrated that causes the sorting guide member 43 to rotate forward or reverse at a predetermined angle. The sorting guide member 43 rotates to an opened state of projecting upward from the second passage section 22 to open the sorting hole 41, and to a closed state of being drawn into the second passage section 22 to block the sorting hole 41.

The control apparatus 200 normally makes the closed state of the sorting guide member 43 being drawn into the second passage section 22 the standby state. In this standby state, a coin that tries to pass the first sorting section 40, by moving over the sorting guide member 43, avoids dropping into the sorting hole 41, and by passing this sorting hole 41, additionally moves to the downstream side in the second passage section 22. On the other hand, in the opened state in which the control apparatus 200 drives the sorting drive section 204 to cause the sorting guide member 43 to project above the second passage section 22, a coin that tries to pass the first sorting section 40 is guided by the sorting guide member 43 to be drawn into the sorting hole 41, and so drops into the sorting hole 41.

As shown in FIG. 1, coin detection sensors 44*a* and 44*b* are provided at positions just before the upstream side of the sorting hole 41 in the second passage section 22. The coin detection sensors 44*a* and 44*b* measure the timing of driving the sorting guide member 43 and count coins. Coin detection sensors 44*c* and 44*d* are provided at positions just after the downstream side of the sorting hole 41. That is, when the control apparatus 200 causes the sorting guide member 43 to project over the second passage section 22 for a predetermined time by the sorting drive section 204 based on the timing at which a target coin is detected by the upstream side coin detection sensors 44*a* and 44*b*, only this target coin is made to drop into the sorting hole 41. Also, when a coin is detected by the coin detection sensors 44*a* and 44*b*, the control apparatus 200 counts this coin. The downstream side coin detection sensors 44*c* and 44*d* serve to confirm that a coin has dropped into the sorting hole 41. If a coin is detected by the upstream side coin detection sensors 44*a* and 44*b*, and this coin is not detected by the downstream side coin detection sensors 44*c* and 44*d*, the control apparatus 200 determines that the coin that was counted by the coin detection sensors 44*a* and 44*b* has dropped into the sorting hole 41. On the other hand, if a coin is detected by the upstream side coin detection sensors 44*a* and 44*b*, and this coin is detected by the downstream side coin detection sensors 44*c* and 44*d*, the control apparatus 200 determines that the coin that was counted by the coin detection sensors 44*a* and 44*b* has passed the sorting hole 41 without dropping therein.

Figure 3:
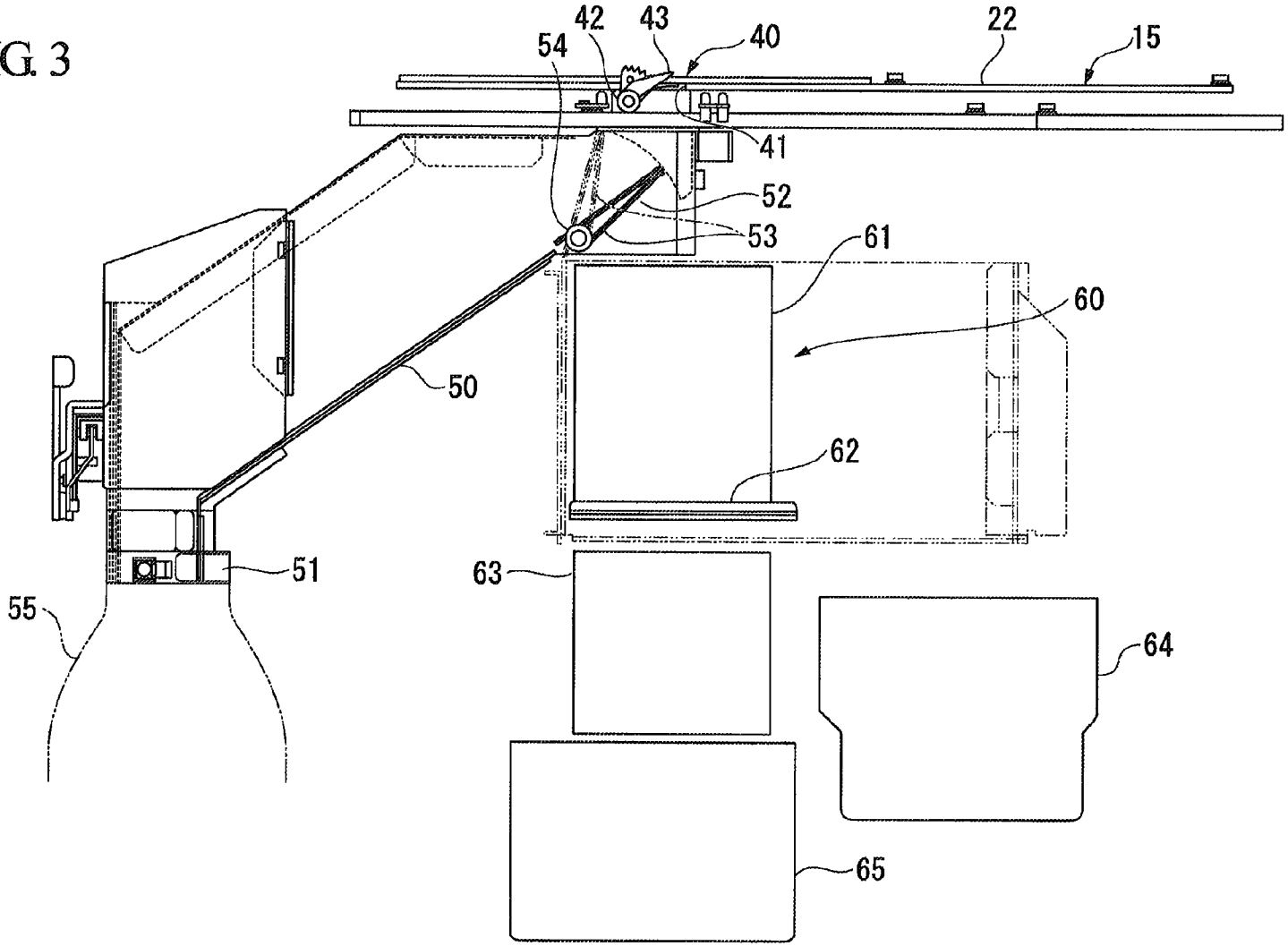
FIG. 3 is a view seen from the direction of arrow A in FIG. 1 of the coin processing apparatus according to the one embodiment of the present invention.

As shown in FIG. 3, a counting chute 50 for bagging is provided on the underside of the first sorting section 40. The counting chute 50 guides obliquely downward coins that have dropped from the sorting hole 41. At the lower end of this counting chute 50, a mounting opening 51 is provided on which a collection bag 55 for bagging of coins is mounted. The collection bag 55 that is mounted on this mounting opening 51 collects the coins that have dropped from the sorting hole 41.

The counting chute 50 has a gate hole 52 at a position directly below the sorting hole 41. In this gate hole 52 is provided a chute gate 53 that opens and closes the hole 52. This chute gate 53 rotates forward and reverse centered on a rotating shaft 54 that is provided on the bottom end side of the gate hole 52 by driving of a gate drive section 205 shown in FIG. 2 that includes a rotary solenoid that is not illustrated. The closed state of the chute gate 53 in which it blocks the gate hole 52 is made the standby state. By the driving of the gate drive section 205 from this standby state, the chute gate 53 enters an opened state of opening the gate hole 52 and also blocking the side opposite the sorting hole 41 with respect to the gate hole 52 of the counting chute 50. Thereby, when the chute gate 53 is in the closed state, all the coins that have dropped from the sorting hole 41 are guided to the mounting opening 51. When the chute gate 53 is in the closed state, all the coins that have dropped from the sorting hole 41 drop so as to pass the gate hole 52.

A temporary storage container 60 is provided on the underside of the gate hole 52. The temporary storage container 60 has a rectangular frame-shaped surrounding wall section 61 that is vertically open, and a bottom plate 62 that blocks the lower portion opening of the surrounding wall section 61. The surrounding wall section 61 is provided to be capable of horizontal movement between a standby position close to the counting chute 50, and a moved position that separates from the counting chute 50. The surrounding wall section 61 moves by driving of a wall movement drive section 206 shown in FIG. 2 that includes a motor not illustrated. The bottom plate 62 is also provided to be capable of horizontal movement between a standby position close to the counting chute 50 and a moved position separated from the counting chute 50. The bottom plate 62 moves by driving of a bottom plate movement drive section 207 shown in FIG. 2 that includes a motor not illustrated.

In the temporary storage container 60, when the surrounding wall section 61 and the bottom plate 62 are in the standby state, the lower opening of the surrounding wall section 61 is blocked by the bottom plate 62, and coins that drop from the gate hole 52 are made to be stored on the bottom plate 62 within the surrounding wall section 61. From this standby state, when only the bottom plate 62 is moved to the moved position, the lower opening of the surrounding wall section 61 opens, and coins are made to drop in this standby position. Moreover, from the standby state when only the surrounding wall section 61 is moved to the moved position, the lower opening of the surrounding wall section 61 that is located in the moved position opens, and coins are made to drop in this moved position.

A discharge chute for boxing 63 is provided at the lower side of the temporary storage container 60 that is in the standby position. The discharge chute for boxing 63 receives and guides the coins that fall by the opening from movement of the bottom plate 62. A return box 64 is provided at the bottom side of the surrounding wall section 61 in the moved position. The return box 64 receives and accommodates the coins that drop by movement to the moved position of the surrounding wall section 61. The return box 64 is detachable from the body of the coin processing apparatus 11. The discharge chute for boxing 63 guides coins to a collection box 65 that is detachable from the body.

As shown in FIG. 1, a second sorting section 70 that is capable of removing a coin from the third passage section 23 is provided in the second passage section 22 side of the third passage section 23. This second sorting section 70 has a sorting hole 71, a sorting guide member 73, and a sorting drive section 208. The sorting hole 71 is formed in the passage surface of the third passage section 23. The sorting guide member 73 is provided at the end portion position of the downstream side in the coin conveying direction of the sorting hole 71, and is capable of rotation centered on a rotating shaft 72 shown in FIG. 4. The sorting drive section 208 is shown in FIG. 2 and includes a rotary solenoid not illustrated that causes the sorting guide member 73 to rotate forward or reverse at a predetermined angle. The sorting guide member 73 is rotated to an opened state of projecting upward from the third passage section 23 to open the sorting section 71, and to a closed state of being drawn into the third passage section 23 to block the sorting hole 71.

The control apparatus 200 normally makes the closed state of the sorting guide member 73 being drawn into the third passage section 23 the standby state. In this standby state, a coin that tries to pass the second sorting section 70, by moving over the sorting guide member 73, avoids dropping into the sorting hole 71, and by passing this sorting hole 71, additionally moves to the downstream side in the third passage section 23. On the other hand, in the opened state in which the control apparatus 200 drives the sorting drive section 208 to cause the sorting guide member 73 to project above the third passage section 23, a coin that tries to pass the second sorting section 70 is guided by the sorting guide member 73 to be drawn into the sorting hole 71, and so drops into the sorting hole 71.

As shown in FIG. 1, coin detection sensors 74*a* and 74*b* are provided at positions just before the upstream side of the sorting hole 71 in the third passage section 23. The coin detection sensors 74*a* and 74*b* measure the timing of driving the sorting guide member 73 and count coins. Coin detection sensors 74*c* and 74*d* are provided at positions just after the downstream side of the sorting hole 71. That is, when the control apparatus 200 causes the sorting guide member 73 to project above the third passage section 23 for a predetermined time by the sorting drive section 208 based on the timing at which a target coin is detected by the upstream side coin detection sensors 74*a* and 74*b*, only this target coin is made to drop into the sorting hole 71. Also, when a coin is detected by the coin detection sensors 74*a* and 74*b*, the control apparatus 200 counts this coin. The downstream side coin detection sensors 74*c* and 74*d* serve to confirm that a coin has dropped into the sorting hole 71. If a coin is detected by the upstream side coin detection sensors 74*a* and 74*b*, and this coin is not detected by the downstream side coin detection sensors 74*c* and 74*d*, the control apparatus 200 determines that the coin that was counted by the coin detection sensors 74*a* and 74*b* has dropped into the sorting hole 71. If a coin is detected by the upstream side coin detection sensors 74*a* and 74*b*, and this coin is detected by the downstream side coin detection sensors 74*c* and 74*d*, the control apparatus 200 determines that the coin that was counted by the coin detection sensors 74*a* and 74*b* has passed the sorting hole 71 without dropping therein.

Figure 4:
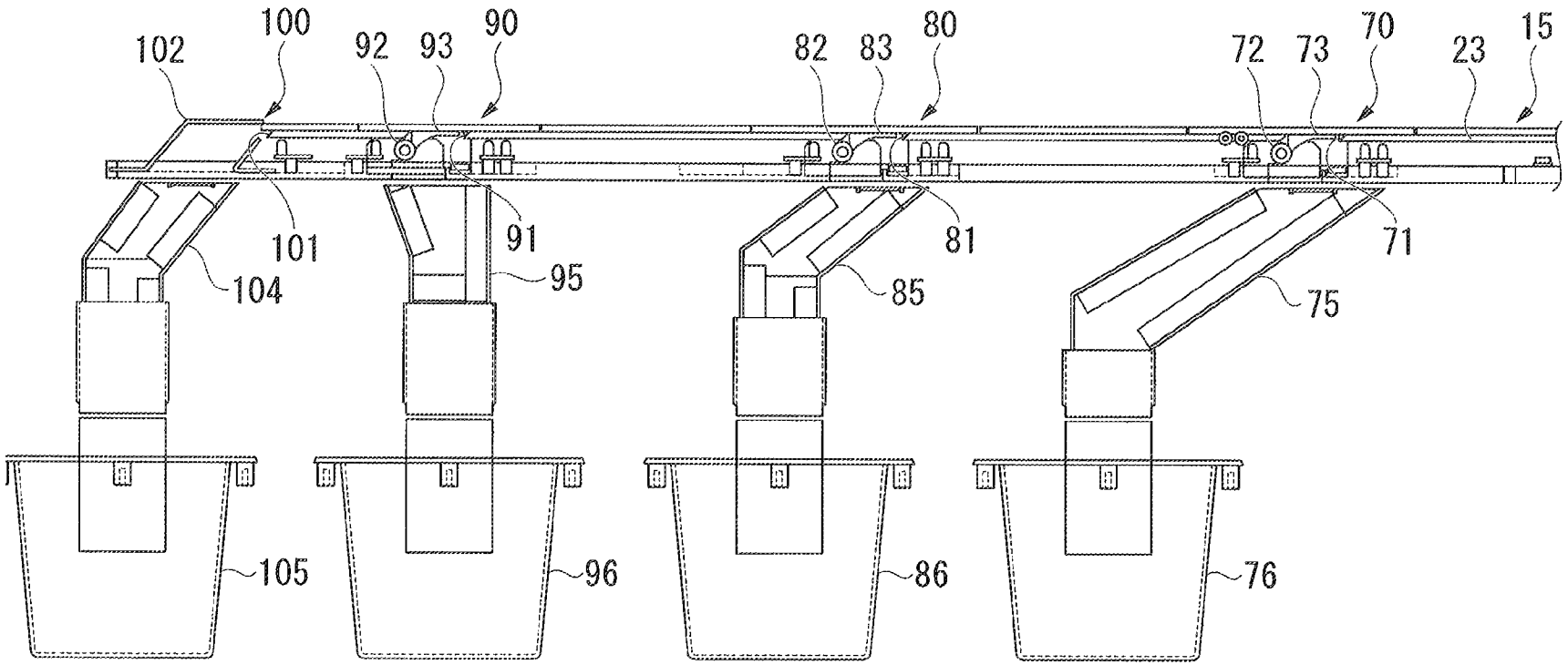
FIG. 4 is a view seen from the direction of arrow B in FIG. 1 of the coin processing apparatus according to the one embodiment of the present invention.

As shown in FIG. 4, a chute 75 that guides obliquely downward coins that have dropped from the sorting hole 71 is provided on the underside of the second sorting section 70. A receiving box 76 is disposed on the bottom side of the chute 75. The chute 75 guides coins that has dropped from the sorting hole 71 to the receiving box 76. The receiving box 76 is freely detachable from the body of the coin processing apparatus 11.

A third sorting section 80 that is capable of removing coins from the third passage section 23 is provided on the downstream side of the second sorting section 70 in the third passage section 23. This third sorting section 80 has a sorting hole 81, a sorting guide member 83, and a sorting drive section 209. The sorting hole 81 is formed in the passage surface of the third passage section 23. The sorting guide member 83 is provided at the end portion position of the downstream side in the coin conveying direction of this sorting hole 81, and is constituted to be capable of rotation centered on a rotating shaft 82. The sorting drive section 209 is shown in FIG. 2 and includes a rotary solenoid not illustrated that causes the sorting guide member 83 to rotate forward or reverse at a predetermined angle. The sorting guide member 83 rotates to an opened state of projecting upward from the third passage section 23 to open the sorting hole 81, and to a closed state of being drawn into the third passage section 23 to block the sorting hole 81.

The control apparatus 200 normally makes the closed state of the sorting guide member 83 being drawn into the third passage section 23 the standby state. In this standby state, a coin that tries to pass the third sorting section 80, by moving over the sorting guide member 83, avoids dropping into the sorting hole 81, and by passing this sorting hole 81, additionally moves to the downstream side in the third passage section 23. On the other hand, in the opened state in which the control apparatus 200 drives the sorting drive section 209 to cause the sorting guide member 83 to project above the third passage section 23, a coin that tries to pass the third sorting section 80 is guided by the sorting guide member 83 to be drawn into the sorting hole 81, and so drops into the sorting hole 81.

As shown in FIG. 1, coin detection sensors 84*a* and 84*b* are provided at positions just before the upstream side of the sorting hole 81 in the third passage section 23. The coin detection sensors 84*a* and 84*b* measure the timing of driving the sorting guide member 83 and count coins. Coin detection sensors 84*c* and 84*d* are provided at positions just after the downstream side of the sorting hole 81. That is, when the control apparatus 200 causes the sorting guide member 83 to project above the third passage section 23 for a predetermined time by the sorting drive section 209 based on the timing at which a target coin is detected by the upstream side coin detection sensors 84*a* and 84*b*, only this target coin is made to drop into the sorting hole 81. Also, when a coin is detected by the coin detection sensors 84*a* and 84*b*, the control apparatus 200 counts this coin. The downstream side coin detection sensors 84*c* and 84*d* serve to confirm that a coin has dropped into the sorting hole 81. If a coin is detected by the upstream side coin detection sensors 84*a* and 84*b*, and this coin is not detected by the downstream side coin detection sensors 84*c* and 84*d*, the control apparatus 200 determines that the coin that was counted by the coin detection sensors 84*a* and 84*b* has dropped into the sorting hole 81. If a coin is detected by the upstream side coin detection sensors 84*a* and 84*b*, and this coin is detected by the downstream side coin detection sensors 84*c* and 84*d*, the control apparatus 200 determines that the coin that was counted by the coin detection sensors 84*a* and 84*b* has passed the sorting hole 81 without dropping therein.

As shown in FIG. 4, a chute 85 that guides obliquely downward coins that have dropped from the sorting hole 81 is provided on the underside of the third sorting section 80. This chute 85 guides the coins that drop from the sorting hole 81 to a receiving box 86 that is disposed on the bottom side of the chute 85. The receiving box 86 is freely detachable from the body of the coin processing apparatus 11.

A fourth sorting section 90 that is capable of removing coins from the third passage section 23 is provided on the downstream side of the third sorting section 80 in the third passage section 23. This fourth sorting section 90 has a sorting hole 91, a sorting guide member 93, and a sorting drive section 210. The sorting hole 91 is formed in the passage surface of the third passage section 23. The sorting guide member 93 is provided at the end portion position of the downstream side in the coin conveying direction of this sorting hole 91, and is constituted to be capable of rotation centered on a rotating shaft 92. The sorting drive section 210 is shown in FIG. 2 and includes a rotary solenoid not illustrated that causes the sorting guide member 93 to rotate forward or reverse at a predetermined angle. The sorting guide member 93 rotates to an opened state of projecting upward from the third passage section 23 to open the sorting hole 91, and to a closed state of being drawn into the third passage section 23 to block the sorting hole 91.

The control apparatus 200 normally makes the closed state of the sorting guide member 93 being drawn into the third passage section 23 the standby state. In this standby state, a coin that tries to pass the fourth sorting section 90, by moving over the sorting guide member 93, avoids dropping into the sorting hole 91, and by passing this sorting hole 91, additionally moves to the downstream side in the third passage section 23. On the other hand, in the opened state in which the control apparatus 200 drives the sorting drive section 210 to cause the sorting guide member 93 to project above the third passage section 23, a coin that tries to pass the fourth sorting section 90 is guided by the sorting guide member 93 to be drawn into the sorting hole 91, and so drops into the sorting hole 91.

As shown in FIG. 1, coin detection sensors 94*a* and 94*b* are provided at positions just before the upstream side of the sorting hole 91 in the third passage section 23. The coin detection sensors 94*a* and 94*b* measure the timing of driving the sorting guide member 93 and count coins. Coin detection sensors 94*c* and 94*d* are provided at positions just after the downstream side of the sorting hole 91. That is, when the control apparatus 200 causes the sorting guide member 93 to project above the third passage section 23 for a predetermined time by the sorting drive section 210 based on the timing at which a target coin is detected by the upstream side coin detection sensors 94*a* and 94*b*, only this target coin is made to drop into the sorting hole 91. Also, when a coin is detected by the coin detection sensors 94*a* and 94*b*, the control apparatus 200 counts this coin. The downstream side coin detection sensors 94*c* and 94*d* serve to confirm that a coin has dropped into the sorting hole 91. If a coin is detected by the upstream side coin detection sensors 94*a* and 94*b*, and this coin is not detected by the downstream side coin detection sensors 94*c* and 94*d*, the control apparatus 200 determines that the coin that was counted by the coin detection sensors 94*a* and 94*b* has dropped into the sorting hole 91. If a coin is detected by the upstream side coin detection sensors 94*a* and 94*b*, and this coin is detected by the downstream side coin detection sensors 94*c* and 94*d*, the control apparatus 200 determines that the coin that was counted by the coin detection sensors 94*a* and 94*b* has passed the sorting hole 91 without dropping therein.

As shown in FIG. 4, a chute 95 that guides downward coins that have dropped from the sorting hole 91 is provided on the underside of the fourth sorting section 90. This chute 95 guides the coins that drop from the sorting hole 91 to a receiving box 96 that is disposed on the bottom side of the chute 95. The receiving box 96 is freely detachable from the body of the coin processing apparatus 11.

A fifth sorting section 100 that is capable of discharging coins from the third passage section 23 is provided on the downstream side of the fourth sorting section 90 in the third passage section 23. This fifth sorting section 100 has a sorting hole 101, and a guide 102. The sorting hole 101 is formed in the passage surface of the third passage section 23. The guide 102 is disposed so as to cover the sorting hole 101, and draws coins into the sorting hole 101. The fifth sorting section 100 discharges from the third passage section 23 all of the coins that were not removed from the third passage section 23 by the fourth sorting section 90. As shown in FIG. 1, coin detection sensors 103*a* and 103*b* are provided at positions just before the upstream side of the sorting hole 101 in the third passage section 23. The coin detection sensors 103*a* and 103*b* confirm the dropping of coins from the sorting hole 101.

As shown in FIG. 4, a chute 104 that guides obliquely downward coins that drop from the sorting hole 101 is provided on the underside of the fifth sorting section. This chute 104 guides the coins that drop from the sorting hole 101 to a receiving box 105 that is disposed on the bottom side of the chute 104. The receiving box 105 is freely detachable from the body of the coin processing apparatus 11.

The coin processing apparatus 11 of the present embodiment further includes an operating section (mode setting section, identification factor setting section) 15 shown in FIG. 2 that includes a keyboard on which operation input is performed by the operator, and a display section 216 that includes a liquid crystal display that performs display to the operator.

The coin processing apparatus 11 is capable of coin processing in a plurality of operation modes that are selected and set by operation input to the operating section 215. Hereinbelow, the each operation mode shall be described.

[Identification Mode]

The identification mode is an operation mode that performs a process of identifying and counting of coins that are inserted onto the supply disk 13, the coins being of a plurality of denominations that can be handled of one specific country that is set in advance, and bagging from the counting chute 50 or boxing from the discharge chute 63 coins that are normal coins of one set denomination that is freely set at each execution of the identification mode.

The process and the coin distribution setting in the identification mode are as follows.

(1) The case of one set denomination being set, and all coin processing with bagging at the counting chute 50 being selected by operation input to the operating section 215.

The control apparatus 200 drives the supply drive section 201 and the conveyance drive section 202 upon the all coin processing start in the identification mode. Thereby, the supply disk 13 and the rotating disk 14 rotate, and the conveyor belts 27A to 27I of the coin conveying section 26 rotate. Thereby, coins of the supply disk 13 are transferred to the rotating disk 14, and the coins are paid out one at a time from the rotating disk 14 to the coin passage 15, and conveyed in a row on the coin passage 15.

During the all coin processing in the identification mode, the control apparatus 200 discharges from the coin passage 15 at the first sorting section 40 those coins that are identified as normal coins of the one set denomination from the identification result of the identifying section 34, and collects them in the collection bag 55 via the counting chute 50. At that time, the normality/abnormality of the sorting by the first sorting section 40 is confirmed based on the normality/abnormality of the counting of the coin detection sensors 44*a* to 44*d*.

During the all coin processing in the identification mode, the control apparatus 200 removes abnormal coins that are identified as different material false coins from the detection result of the material detection sensor 30 in the identifying section 34 and abnormal coins that are identified as different diameter false coins from the detection result of the outer-diameter detection sensor 31 in the identifying section 34 from the coin passage 15 at the second sorting section 70, and collects them in the receiving box 76 via the chute 75. At that time, the normality/abnormality of the sorting by the second sorting section 70 is confirmed based on the normality/abnormality of the counting of the coin detection sensors 74*a* to 74*d*. In the identification mode, in the case of a coin of a country other than the one specified country being intermixed, this coin is identified as a different material false coin if of a different material, and identified as a different diameter false coin if of the same material and having a different diameter, and removed from the coin passage 15 at the second sorting section 70.

During the all coin processing in the identification mode, the control apparatus 200 removes abnormal coins that are identified as different image false coins from the detection result of the lower-side image detection section 32 in the identifying section 34 and abnormal coins that are identified as different image false coins from the detection result of the upper-side image detection section 33 in the identifying section 34 from the coin passage 15 at the third sorting section 80, and collects them in the receiving box 86 via the chute 85. At that time, the normality/abnormality of the sorting by the third sorting section 80 is confirmed based on the normality/abnormality of the counting of the coin detection sensors 84*a* to 84*d*. In the identification mode, in the case of a coin of a country other than the one specified country being intermixed, this coin is identified as a different image false coin if of the same material and same diameter and having a different image, and removed from the coin passage 15 at the third sorting section 80.

During the all coin processing in the identification mode, the control apparatus 200 removes abnormal coins that are identified as reflection-contaminated/damaged genuine coins from the detection result of the reflected-light-quantity detection sensors 35, 35 in the identifying section 34, abnormal coins that are identified as image-contaminated/damaged genuine coins from the detection result of the lower-side image detection section 32, and abnormal coins that are identified as image-contaminated/damaged genuine coins from the detection result of the upper-side image detection section 33 from the coin passage 15 at the fourth sorting section 90, and collects them in the receiving box 96 via the chute 95. At that time, the normality/abnormality of the sorting by the fourth sorting section 90 is confirmed based on the normality/abnormality of the counting of the coin detection sensors 94*a* to 94*d*.

During the all coin processing in the identification mode, the control apparatus 200 discharges coins that are normal coins other than the one set denomination (coins other than the one set denomination among the coins of all denominations of the one specified country) from the coin passage 15 at the fifth sorting section 100, and collects them in the receiving box 105 via the chute 104. At that time, the normality/abnormality of the sorting by the fifth sorting section 100 is confirmed based on the normality/abnormality of the counting of the coin detection sensors 103*a* and 103*b*.

When the collection of all the coins fed to the supply disk 13 to any corresponding among the collection bag 55 and the receiving boxes 76, 86, 96, 105 is completed with no counting abnormalities, the control apparatus 200 stops the supply drive section 201 and the conveyance drive section 202. Also, the control apparatus 200 stores in association with date data and the like a gist that the all coin processing in the identification mode ended normally, the collection number in each of the collection bag 55 and the receiving boxes 76, 86, 96, 105, the classification of coins collected in each of the collection bag 55 and the receiving boxes 76, 86, 96, 105, and also displays them on the display section 216. The classification of coins collected in each of the collection bag 55 and the receiving boxes 76, 86, 96, 105 means that the coins of the collection bag 55 are normal coins and coins of the one set denomination, the coins of the receiving box 76 are abnormal coins and different material false coins or different diameter false coins, the coins of the receiving box 86 are abnormal coins and different image false coins, the coins of the receiving box 96 are abnormal coins and reflection-contaminated/damaged genuine coins or image-contaminated/damaged genuine coins, and the coins of the receiving box 105 are normal coins and coins other than the one set denomination. By the above process, the all coin processing in the identification mode ends. Even when there are abnormal coins as stated above, provided there are no counting irregularities, from the start to the end of the all coin processing in the identification mode, the control apparatus 200 does not drive the stopper drive section 203, and so the stopper members 36*a* and 36*b* are not made to project into the coin passage 15.

During the all coin processing in the identification mode, the case of a counting abnormality being detected by the identifying section 34, the case of a sorting abnormality of the first sorting section 40 being detected from a counting abnormality of the coin detection sensors 44*a* to 44*d*, the case of a sorting abnormality of the second sorting section 70 being detected from a counting abnormality of the coin detection sensors 74*a* to 74*d*, the case of a sorting abnormality of the third sorting section 80 being detected from a counting abnormality of the coin detection sensors 84*a* to 84*d*, the case of a sorting abnormality of the fourth sorting section 90 being detected from a counting abnormality of the coin detection sensors 94*a* to 94*d*, and the case of a sorting abnormality of the fifth sorting section 100 being detected from a counting abnormality of the coin detection sensors 103*a* and 103*b* shall be described. For each of these cases, at the point in time of detection, the control apparatus 200 stops the paying out of coins from the supply disk 13 and the rotating disk 14 by stopping the supply drive section 201. Along with that, the control apparatus 200 drives the stopper drive section 203 to cause the stopper members 36*a* and 36*b* to project out and thereby stop coins on the upstream side of the stopper members 36*a* and 36*b*. Also, the control apparatus 200 discharges coins between the stopper members 36*a* and 36*b* and the first sorting section 40 from the coin passage 15 at the first sorting section 40, and collects them in the collection bag 55 via the counting chute 50. In addition, the control apparatus 200 causes the sorting of coins on the downstream side of the first sorting section 40 set to be sorted by corresponding one of the second sorting section 70, the third sorting section 80, the fourth sorting section 90, and the fifth sorting section 100, respectively. When the coins on the coin passage 15 that are on the downstream side of the stopper members 36*a* and 36*b* disappear, the control apparatus 200 reverses the supply drive section 201 and the conveyance drive section 202 to return the coins between the rotating disk 14 and the stopper members 36*a* and 36*b* to the rotating disk 14. Then, the control apparatus 200 displays on the display section 216 the gist that a counting abnormality has occurred, the presence of collected coins in each of the collection bag 55 and the receiving boxes 76, 86, 96, 105, and a gist urging repeat processing by the identification mode. Seeing this, the operator takes out the collected coins from the collection bag 55 and the receiving boxes 76, 86, 96, 105, and after removing the unnecessary ones, supplies them to the supply disk 13 and once again executes processing by the identification mode.

(2) The case of one set denomination being set, batch processing with boxing at the counting chute 50 being selected, and the batch capture number being set by operation input to the operating section 215.

Upon the start of batch processing in the identification mode, the control apparatus 200 drives the gate drive section 205 to put the chute gate 53 into the opened state. Along with that, the control apparatus 200 drives the supply drive section 201 and the conveyance drive section 202. Thereby, the supply disk 13 and the rotating disk 14 rotate, and the conveyor belts 27A to 27I of the coin conveying section 26 rotate. Thereby, coins of the supply disk 13 are transferred to the rotating disk 14, and the coins are paid out one at a time from the rotating disk 14 to the coin passage 15, and conveyed in a row on the coin passage 15.

During the batch processing in the identification mode, the control apparatus 200 discharges from the coin passage 15 in the first sorting section 40, by just the set batch capture number, those coins that are identified as normal coins of the one set denomination from the identification result of the identifying section 34, and stores them from the measuring chute 50 to the temporary storage container 60 with the chute gate 53 in the opened state. At that time, the normality/abnormality of the sorting by the first sorting section 40 is confirmed based on the normality/abnormality of the counting of the coin detection sensors 44*a* to 44*d*.

During the batch processing in the identification mode, the control apparatus 200 removes from the coin passage 15 at the second sorting section 70 abnormal coins that are identified as different material false coins from the detection result of the material detection sensor 30 in the identifying section 34 and abnormal coins that are identified as different diameter false coins from the detection result of the outer-diameter detection sensor 31 in the identifying section 34, and collects them in the receiving box 76 via the chute 75. At that time, the normality/abnormality of the sorting by the second sorting section 70 is confirmed based on the normality/abnormality of the counting of the coin detection sensors 74*a* to 74*d*. In the identification mode, in the case of a coin of a country other than the one specified country being intermixed, this coin is identified as a different material false coin if of a different material, and identified as a different diameter false coin if of the same material and having a different diameter, and removed from the coin passage 15 at the second sorting section 70.

During the batch processing in the identification mode, the control apparatus 200 removes abnormal coins that are identified as different image false coins from the detection result of the lower-side image detection section 32 in the identifying section 34 and abnormal coins that are identified as different image false coins from the detection result of the upper-side image detection section 33 in the identifying section 34 from the coin passage 15 at the third sorting section 80, and collects them in the receiving box 86 via the chute 85. At that time, the normality/abnormality of the sorting by the third sorting section 80 is confirmed based on the normality/abnormality of the counting of the coin detection sensors 84*a* to 84*d*. In the identification mode, in the case of a coin of a country other than the one specified country being intermixed, this coin is identified as a different image false coin if of the same material and same diameter and having a different image, and removed from the coin passage 15 at the third sorting section 80.

During the batch processing in the identification mode, the control apparatus 200 removes abnormal coins that are identified as reflection-contaminated/damaged genuine coins from the detection result of the reflected-light-quantity detection sensors 35, 35 in the identifying section 34, abnormal coins that are identified as image-contaminated/damaged genuine coins from the detection result of the lower-side image detection section 32, and abnormal coins that are identified as image-contaminated/damaged genuine coins from the detection result of the upper-side image detection section 33 from the coin passage 15 at the fourth sorting section 90, and collects them in the receiving box 96 via the chute 95. At that time, the normality/abnormality of the sorting by the fourth sorting section 90 is confirmed based on the normality/abnormality of the counting of the coin detection sensors 94*a* to 94*d*.

During the batch processing in the identification mode, the control apparatus 200 discharges coins that are normal coins other than the one set denomination (coins other than the one set denomination among the coins of all denominations of the one specified country) from the coin passage 15 at the fifth sorting section 100, and collects them in the receiving box 105 via the chute 104. At that time, the normality/abnormality of the sorting by the fifth sorting section 100 is confirmed based on the normality/abnormality of the counting of the coin detection sensors 103*a* and 103*b*.

At the timing at which the last coin of the set batch capture number that is the one set denomination can be determined to have passed the stopper members 36*a* and 36*b* based on the detection by the coin detection sensors 37*a* and 37*b*, the control apparatus 200 stops the paying out of coins from the supply disk 13 and the rotating disk 14 by stopping the supply drive section 201. Moreover, the control apparatus 200 drives the stopper drive section 203 to cause the stopper members 36*a* and 36*b* to project out and thereby stop coins on the upstream side of the last coin, and causes the coins on the downstream side of the stopper member 36*a* and 36*b* to be collected to any corresponding among the temporary storage container 60 and the receiving boxes 76, 86, 96, and 105. When the coins on the downstream side of the stopper members 36*a* and 36*b* on the coin passage 15 disappear, the control apparatus 200 reverses the supply drive section 201 and the conveyance drive section 202 to return the coins between the rotating disk 14 and the stopper members 36*a* and 36*b* to the rotating disk 14.

When the collection to the temporary storage container 60 of coins of the one set denomination, by just the set batch capture number, is completed with no counting abnormalities, and the collection to any corresponding among the receiving boxes 76, 86, 96, and 105 of other coins that occurs during the batch processing in the identification mode is completed, the control apparatus 200 collects the coins of the temporary storage container 60 to the collection box 65 via the discharge chute 63. Along with that, the control apparatus 200 stores in association with date data and the like a gist that the batch processing in the identification mode normally ended, the collection number in each of the collection box 65 and the receiving boxes 76, 86, 96, 105, and the classification of coins collected in each of the collection box 65 and the receiving boxes 76, 86, 96, 105, and also displays them on the display section 216. The classification of coins collected in each of the collection box 65 and the receiving boxes 76, 86, 96, 105 means that the coins of the collection box 65 are normal coins and coins of the one set denomination, the coins of the receiving box 76 are different material false coins or different diameter false coins, the coins of the receiving box 86 are abnormal coins and different image false coins, the coins of the receiving box 96 are abnormal coins and reflection-contaminated/damaged genuine coins or image-contaminated/damaged genuine coins, and the coins of the receiving box 105 are normal coins and coins other than the one set denomination. By the above process, the batch processing in the identification mode ends. Even when there are abnormal coins as stated above, provided there are no counting irregularities, after the start of the batch processing in the identification mode and until stopping the next coin after the last coin of the batch capture number, the control apparatus 200 does not drive the stopper drive section 203, and so the stopper members 36*a* and 36*b* are not made to project into the coin passage 15.

During the batch processing in the identification mode, the case of a counting abnormality being detected by the identifying section 34, the case of a sorting abnormality of the first sorting section 40 being detected from a counting abnormality of the coin detection sensors 44*a* to 44*d*, the case of a sorting abnormality of the second sorting section 70 being detected from a counting abnormality of the coin detection sensors 74*a* to 74*d*, the case of a sorting abnormality of the third sorting section 80 being detected from a counting abnormality of the coin detection sensors 84*a* to 84*d*, the case of a sorting abnormality of the fourth sorting section 90 being detected from a counting abnormality of the coin detection sensors 94*a* to 94*d*, and the case of a sorting abnormality of the fifth sorting section 100 being detected from a counting abnormality of the coin detection sensors 103*a* and 103*b* shall be described. For each of these cases, at the point in time of detection, the control apparatus 200 stops the paying out of coins from the supply disk 13 and the rotating disk 14 by stopping the supply drive section 201. Along with that, the control apparatus 200 drives the stopper drive section 203 to cause the stopper members 36*a* and 36*b* to project out and thereby stop coins on the upstream side of the stopper members 36*a* and 36*b*. Also, the control apparatus 200 discharges coins between the stopper members 36*a* and 36*b* and the first sorting section 40 from the coin passage 15 at the first sorting section 40, and stores them in the temporary storage container 60 via the counting chute 50. In addition, the control apparatus 200 causes the sorting of coins on the downstream side of the first sorting section 40 set to be sorted by one of the second sorting section 70, the third sorting section 80, the fourth sorting section 90, and the fifth sorting section 100, respectively. When the coins on the coin passage 15 that are on the downstream side of the stopper members 36*a* and 36*b* disappear, the control apparatus 200 collects the coins of the temporary storage container 60 to the return box 64, and also reverses the supply drive section 201 and the conveyance drive section 202 to return the coins between the rotating disk 14 and the stopper members 36*a* and 36*b* to the rotating disk 14. Then, the control apparatus 200 displays on the display section 216 the gist that a counting abnormality has occurred, the presence of collected coins in each of the return box 64 and the receiving boxes 76, 86, 96, 105, and a gist urging repeat processing by the identification mode. Seeing this, the operator takes out the collected coins from the return box 64 and the receiving boxes 76, 86, 96, 105, and after removing the unnecessary ones, supplies them to the supply disk 13 and once again executes processing by the identification mode.

In the above identification mode, two sorting sections, namely, the first sorting section 40 and the fifth sorting section 100 constitute a discharging section that discharges from the coin passage 15 normal coins that are identified as normal by the identifying section 34. Three sorting sections, namely, the second sorting section 70, the third sorting section 80, and the fourth sorting section 90 constitute a removing section that removes from the coin passage 15 abnormal coins that are identified as abnormal by the identifying section 34. The first sorting section 40 that is one of the first sorting section 40 and the fifth sorting section 100 constitutes a specified discharging section that discharges coins that are normal coins of a specified denomination. The fifth sorting section 100, which is the other of the two, constitutes an unspecified discharging section that discharges coins that are normal coins other than normal coins of the specified denomination. The counting chute 50 for bagging coins that are normal coins of the specified denomination and the discharge chute 63 for boxing coins that are normal coins of the specified denomination, which are subsequent to the first sorting section 40, also constitute the unspecified discharging section. The control apparatus 200, in the case of removing an abnormal coin, performs removal by distribution to the three sorting sections of the second sorting section 70, the third sorting section 80 and the fourth sorting section 90, in accordance with the identification factor of the abnormal coin.

[Counting Mode]

The counting mode is an operation mode that performs a process of identifying coins that are inserted onto the supply disk 13, the coins being normal coins, of one specific country that is set in advance, and of one set denomination that is freely set at each execution of the counting mode, based only on the detection results of the material detection sensor 30 and the outer-diameter detection sensor 31 of the identifying section 34, and bagging them from the counting chute 50 or boxing them from the discharge chute 63.

The process and the coin distribution setting in the counting mode are as follows.

(1) The case of one set denomination being set, and all coin processing with bagging at the counting chute 50 being selected by operation input to the operating section 215.

The control apparatus 200 drives the supply drive section 201 and the conveyance drive section 202 upon the all coin processing start in the counting mode. Thereby, the supply disk 13 and the rotating disk 14 rotate, and the conveyor belts 27A to 27I of the coin conveying section 26 rotate. Thereby, coins of the supply disk 13 are transferred to the rotating disk 14, and the coins are paid out one at a time from the rotating disk 14 to the coin passage 15, and conveyed in a row on the coin passage 15.

During the all coin processing in the counting mode, the control apparatus 200 discharges from the coin passage 15 at the first sorting section 40 those coins that are identified as normal coins of the one set denomination from the identification result of the identifying section 34, and collects them in the collection bag 55 via the counting chute 50. At that time, the normality/abnormality of the sorting by the first sorting section 40 is confirmed based on the normality/abnormality of the counting of the coin detection sensors 44*a* to 44*d*.

During the all coin processing in the counting mode, the control apparatus 200 removes abnormal coins that are identified as different material false coins from the detection result of the material detection sensor 30 in the identifying section 34 and abnormal coins that are identified as different diameter false coins from the detection result of the outer-diameter detection sensor 31 in the identifying section 34 from the coin passage 15 at the second sorting section 70, and collects them in the receiving box 76 via the chute 75. At that time, the normality/abnormality of the sorting by the second sorting section 70 is confirmed based on the normality/abnormality of the counting of the coin detection sensors 74*a* to 74*d*. In the counting mode, in the case of a coin other than the one set denomination and a coin of a country other than the one specified country being intermixed, this coin is identified as a different material false coin if of a different material, and identified as a different diameter false coin if of the same material and having a different diameter, and removed from the coin passage 15 at the second sorting section 70.

During the all coin processing in the counting mode, the control apparatus 200 removes abnormal coins that are identified as reflection-contaminated/damaged genuine coins from the detection result of the reflected-light-quantity detection sensors 35, 35 in the identifying section 34 from the coin passage 15 at the fourth sorting section 90, and collects them in the receiving box 96 via the chute 95. At that time, the normality/abnormality of the sorting by the fourth sorting section 90 is confirmed based on the normality/abnormality of the counting of the coin detection sensors 94*a* to 94*d*.

When the collection of all the coins that were fed to the supply disk 13 to any corresponding among the collection bag 55 and the receiving boxes 76 and 96 is completed with no counting abnormalities, the control apparatus 200 stops the supply drive section 201 and the conveyance drive section 202. Also, the control apparatus 200 stores in association with date data and the like a gist that the all coin processing in the counting mode ended normally, the collection number in each of the collection bag 55 and the receiving boxes 76 and 96, the classification of coins collected in each of the collection bag 55 and the receiving boxes 76 and 96, and also displays them on the display section 216. The classification of coins collected in each of the collection bag 55 and the receiving boxes 76 and 96 means that the coins of the collection bag 55 are normal coins and coins of the one set denomination, the coins of the receiving box 76 are abnormal coins and different material false coins or different diameter false coins, and the coins of the receiving box 96 are abnormal coins and reflection-contaminated/damaged genuine coins. By the above process, the all coin processing in the counting mode ends. Even when there are abnormal coins as stated above, provided there are no counting irregularities, from the start to the end of the all coin processing in the counting mode, the control apparatus 200 does not drive the stopper drive section 203, and so the stopper members 36*a* and 36*b* are not made to project into the coin passage 15.

During the all coin processing in the counting mode, the case of detecting a counting abnormality by the identifying section 34, the case of detecting a sorting abnormality of the first sorting section 40 from a counting abnormality of the coin detection sensors 44*a* to 44*d*, the case of detecting a sorting abnormality of the second sorting section 70 from a counting abnormality of the coin detection sensors 74*a* to 74*d*, and the case of detecting a sorting abnormality of the fourth sorting section 90 from a counting abnormality of the coin detection sensors 94*a* to 94*d* shall be described. For each of these cases, at the point in time of detection, the control apparatus 200 stops the paying out of coins from the supply disk 13 and the rotating disk 14 by stopping the supply drive section 201. Along with that, the control apparatus 200 drives the stopper drive section 203 to cause the stopper members 36*a* and 36*b* to project out and thereby stop coins on the upstream side of the stopper members 36*a* and 36*b*. Also, the control apparatus 200 discharges coins between the stopper members 36*a* and 36*b* and the first sorting section 40 from the coin passage 15 at the first sorting section 40, and collects them in the collection bag 55 via the counting chute 50. In addition, the control apparatus 200 causes the sorting of coins on the downstream side of the first sorting section 40 set to be sorted by one of the second sorting section 70 and the fourth sorting section 90, respectively. When the coins on the coin passage 15 that are on the downstream side of the stopper members 36*a* and 36*b* disappear, the control apparatus 200 reverses the supply drive section 201 and the conveyance drive section 202 to return the coins between the rotating disk 14 and the stopper members 36*a* and 36*b* to the rotating disk 14. Then, the control apparatus 200 displays on the display section 216 the gist that a counting abnormality has occurred, the presence of collected coins in each of the collection bag 55 and the receiving boxes 76 and 96, and a gist urging repeat processing by the counting mode. Seeing this, the operator takes out the collected coins from any corresponding among the collection bag 55 and the receiving boxes 76 and 96, and after removing the unnecessary ones, supplies them to the supply disk 13 and once again executes processing by the counting mode.

(2) The case of one set denomination being set, batch processing with boxing at the counting chute 50 being selected, and the batch capture number being set by operation input to the operating section 215.

Upon the start of batch processing in the counting mode, the control apparatus 200 drives the gate drive section 205 to put the chute gate 53 into the opened state. Along with that, the control apparatus 200 drives the supply drive section 201 and the conveyance drive section 202. Thereby, the supply disk 13 and the rotating disk 14 rotate, and the conveyor belts 27A to 27I of the coin conveying section 26 rotate. Thereby, coins of the supply disk 13 are transferred to the rotating disk 14, and the coins are paid out one at a time from the rotating disk 14 to the coin passage 15, and conveyed in a row on the coin passage 15.

During the batch processing in the counting mode, the control apparatus 200 discharges from the coin passage 15 in the first sorting section 40, by just the set batch capture number, those coins that are identified as normal coins of the one set denomination from the identification result of the identifying section 34, and stores them from the measuring chute 50 to the temporary storage container 60 with the chute gate 53 in the opened state. At that time, the normality/abnormality of the sorting by the first sorting section 40 is confirmed based on the normality/abnormality of the counting of the coin detection sensors 44*a* to 44*d*.

During the batch processing in the counting mode, the control apparatus 200 removes abnormal coins that are identified as different material false coins from the detection result of the material detection sensor 30 in the identifying section 34 and abnormal coins that are identified as different diameter false coins from the detection result of the outer-diameter detection sensor 31 in the identifying section 34 from the coin passage 15 at the second sorting section 70, and collects them in the receiving box 76 via the chute 75. At that time, the normality/abnormality of the sorting by the second sorting section 70 is confirmed based on the normality/abnormality of the counting of the coin detection sensors 74*a* to 74*d*. Note that in the counting mode, in the case of a coin other than the one set denomination and a coin of a country other than the one specified country being intermixed, this coin is identified as a different material false coin if of a different material, and identified as a different diameter false coin if of the same material and having a different diameter, and removed from the coin passage 15 at the second sorting section 70.

Also, during the batch processing in the counting mode, the control apparatus 200 removes abnormal coins that are identified as reflection-contaminated/damaged genuine coins from the detection result of the reflected-light-quantity detection sensors 35, 35 in the identifying section 34 from the coin passage 15 at the fourth sorting section 90, and collects them in the receiving box 96 via the chute 95. At that time, the normality/abnormality of the sorting by the fourth sorting section 90 is confirmed based on the normality/abnormality of the counting of the coin detection sensors 94*a* to 94*d*.

At the timing at which the last coin of the set batch capture number that is the one set denomination can be determined to have passed the stopper members 36*a* and 36*b* based on the detection by the coin detection sensors 37*a* and 37*b*, the control apparatus 200 stops the paying out of coins from the supply disk 13 and the rotating disk 14 by stopping the supply drive section 201. Moreover, the control apparatus 200 drives the stopper drive section 203 to cause the stopper members 36*a* and 36*b* to project out and thereby stop coins on the upstream side of the last coin, and causes the coins on the downstream side of the stopper member 36*a* and 36*b* to be collected to any corresponding among the temporary storage container 60 and the receiving boxes 76, 86, 96, and 105. When the coins on the downstream side of the stopper members 36*a* and 36*b* on the coin passage 15 disappear, the control apparatus 200 reverses the supply drive section 201 and the conveyance drive section 202 to return the coins between the rotating disk 14 and the stopper members 36*a* and 36*b* to the rotating disk 14.

When the collection to the temporary storage container 60 of the set batch capture number of coins of the one set denomination is completed with no counting abnormalities, and the collection to any corresponding among the receiving boxes 76 and 96 of other coins that occurs during the batch processing in the counting mode is completed, the control apparatus 200 collects the coins of the temporary storage container 60 to the collection box 65 via the discharge chute 63. Also, the control apparatus 200 stores in association with date data and the like a gist that the batch processing in the counting mode normally ended, the collection number in each of the collection box 65 and the receiving boxes 76 and 96, the classification of coins collected in each of the collection box 65 and the receiving boxes 76 and 96, and also displays them on the display section 216. The classification of coins collected in each of the collection box 65 and the receiving boxes 76 and 96 means that a gist that the coins of the collection box 65 are normal coins and coins of the one set denomination, the coins of the receiving box 76 are abnormal coins and different material false coins or different diameter false coins, and the coins of the receiving box 96 are abnormal coins and reflection-contaminated/damaged genuine coins. By the above process, the batch processing in the counting mode ends. Even when there are abnormal coins as stated above, provided there are no counting irregularities, after the start of the batch processing in the counting mode and until stopping the next coin after the last coin of the batch capture number, the control apparatus 200 does not drive the stopper drive section 203, and so the stopper members 36*a* and 36*b* are not made to project into the coin passage 15.

During the batch processing in the counting mode, the case of a counting abnormality being detected by the identifying section 34, the case of a sorting abnormality of the first sorting section 40 being detected from a counting abnormality of the coin detection sensors 44*a* to 44*d*, the case of a sorting abnormality of the second sorting section 70 being detected from a counting abnormality of the coin detection sensors 74*a* to 74*d*, and the case of a sorting abnormality of the fourth sorting section 90 being detected from a counting abnormality of the coin detection sensors 94*a* to 94*d* shall be described. For each of these cases, at the point in time of detection, the control apparatus 200 stops the paying out of coins from the supply disk 13 and the rotating disk 14 by stopping the supply drive section 201. Along with that, the control apparatus 200 drives the stopper drive section 203 to cause the stopper members 36*a* and 36*b* to project out and thereby stop coins on the upstream side of the stopper members 36*a* and 36*b*. Also, the control apparatus 200 discharges coins between the stopper members 36*a* and 36*b* and the first sorting section 40 from the coin passage 15 at the first sorting section 40, and collects them in the temporary storage container 60 via the counting chute 50. In addition, the control apparatus 200 causes the sorting of coins on the downstream side of the first sorting section 40 set to be sorted by one of the second sorting section 70 and the fourth sorting section 90, respectively. When the coins on the coin passage 15 that are on the downstream side of the stopper members 36*a* and 36*b* disappear, the control apparatus 200 collects the coins of the temporary storage container 60 to the return box 64, and also reverses the supply drive section 201 and the conveyance drive section 202 to return the coins between the rotating disk 14 and the stopper members 36*a* and 36*b* to the rotating disk 14. Then, the control apparatus 200 displays on the display section 216 the gist that a counting abnormality has occurred, the presence of collected coins in each of the return box 64 and the receiving boxes 76 and 96, and a gist urging repeat processing by the counting mode. Seeing this, the operator takes out the collected coins from the return box 64 and the receiving boxes 76 and 96, and after removing the unnecessary ones, supplies them to the supply disk 13 and once again executes processing by the counting mode.

In the above identification mode, the one first sorting section 40 constitutes a discharging section that discharges normal coins that are identified as normal by the identifying section 34 from the coin passage 15. The two sorting sections of the second sorting section 70 and the fourth sorting section 90 constitute a removing section that removes abnormal coins that are identified as abnormal by the identifying section 34 from the coin passage 15. The control apparatus 200, in the case of removing an abnormal coin, performs removal by distribution to the two sorting sections of the second sorting section 70 and the fourth sorting section 90, in accordance with the identification factor of the abnormal coin.

[Country Sorting Mode]

The country sorting mode is an operation mode that performs a process of identifying and counting of coins that are inserted onto the supply disk 13, the coins being of one denomination of a plurality of countries that can be handled, and bagging from the counting chute 50 or boxing from the discharge chute 63 coins that are normal coins of one set denomination of one specified country that is freely set at each execution of the country mode.

The process and the coin distribution setting in the country sorting mode are as follows.

(1) The case of one set denomination of one specified country being set, and all coin processing with bagging at the counting chute 50 being selected by operation input to the operating section 215.

The control apparatus 200 drives the supply drive section 201 and the conveyance drive section 202 upon the all coin processing start in the country sorting mode. Thereby, the supply disk 13 and the rotating disk 14 rotate, and the conveyor belts 27A to 27I of the coin conveying section 26 rotate. Thereby, coins of the supply disk 13 are transferred to the rotating disk 14, and the coins are paid out one at a time from the rotating disk 14 to the coin passage 15, and conveyed in a row on the coin passage 15.

During the all coin processing in the country sorting mode, the control apparatus 200 discharges from the coin passage 15 at the first sorting section 40 those coins that are identified as normal coins of the one set denomination of the one specified country from the identification result of the identifying section 34, and collects them in the collection bag 55 via the counting chute 50. At that time, the normality/abnormality of the sorting by the first sorting section 40 is confirmed based on the normality/abnormality of the counting of the coin detection sensors 44*a* to 44*d*.

During the all coin processing in the country sorting mode, the control apparatus 200 removes from the coin passage 15 at the second sorting section 70 abnormal coins that are identified as different material false coins from the detection result of the material detection sensor 30 in the identifying section 34 and abnormal coins that are identified as different diameter false coins from the detection result of the outer-diameter detection sensor 31 in the identifying section 34, and collects them in the receiving box 76 via the chute 75. At that time, the normality/abnormality of the sorting by the second sorting section 70 is confirmed based on the normality/abnormality of the counting of the coin detection sensors 74*a* to 74*d*.

During the all coin processing in the country sorting mode, the control apparatus 200 removes from the coin passage 15 at the third sorting section 80 abnormal coins that are identified as different image false coins from the detection result of the lower-side image detection section 32 in the identifying section 34, abnormal coins that are identified as different image false coins from the detection result of the upper-side image detection section 33, abnormal coins that are identified as reflection-contaminated/damaged genuine coins from the detection result of the reflected-light-quantity detection sensors 35, 35, abnormal coins that are identified as image-contaminated/damaged genuine coins from the detection result of the lower-side image detection section 32, and abnormal coins that are identified as image-contaminated/damaged genuine coins from the detection result of the upper-side image detection section 33, and collects them in the receiving box 86 via the chute 85. At that time, the normality/abnormality of the sorting by the third sorting section 80 is confirmed based on the normality/abnormality of the counting of the coin detection sensors 84*a* to 84*d*.

During the all coin processing in the country sorting mode, the control apparatus 200 discharges from the coin passage 15 at the fourth sorting section 90 coins that are normal coins of all denominations other than the one specified country of the plurality of countries that can be handled, and collects them in the receiving box 96 via the chute 95. At that time, the normality/abnormality of the sorting by the fourth sorting section 90 is confirmed based on the normality/abnormality of the counting of the coin detection sensors 94*a* to 94*d*.

During the all coin processing in the country sorting mode, the control apparatus 200 discharges from the coin passage 15 at the fifth sorting section 100 coins that are normal coins which are coins of the one specified country among the plurality of countries that can be handled and coins other than the one set denomination, and collects them in the receiving box 105 via the chute 104. At that time, the normality/abnormality of the sorting by the fifth sorting section 100 is confirmed based on the normality/abnormality of the counting of the coin detection sensors 103*a* and 103*b*.

When the collection of all the coins fed to the supply disk 13 to any corresponding among the collection bag 55 and the receiving boxes 76, 86, 96, 105 is completed with no counting abnormalities, the control apparatus 200 stops the supply drive section 201 and the conveyance drive section 202. Also, the control apparatus 200 stores in association with date data and the like a gist that the all coin processing in the country sorting mode ended normally, the collection number in each of the collection bag 55 and the receiving boxes 76, 86, 96, 105, and the classification of coins collected in each of the collection bag 55 and the receiving boxes 76, 86, 96, 105, and also displays them on the display section 216. The classification of coins collected in each of the collection bag 55 and the receiving boxes 76, 86, 96, 105 means that the coins of the collection bag 55 are normal coins and coins of the one set denomination of the one specified country, the coins of the receiving box 76 are abnormal coins and different material false coins or different diameter false coins, the coins of the receiving box 86 are abnormal coins and different image false coins, reflection-contaminated/damaged genuine coins or image-contaminated/damaged genuine coins, the coins of the receiving box 96 are normal coins and coins other than the one specified country, and the coins of the receiving box 105 are normal coins, coins of the one specified country and coins other than the one set denomination. By the above process, the all coin processing in the country sorting mode ends. Even when there are abnormal coins as stated above, provided there are no counting irregularities, from the start to the end of the all coin processing in the country sorting mode, the control apparatus 200 does not drive the stopper drive section 203, and so the stopper members 36*a* and 36*b* are not made to project into the coin passage 15.

During the all coin processing in the country sorting mode, the case of a counting abnormality being detected by the identifying section 34, the case of a sorting abnormality of the first sorting section 40 being detected from a counting abnormality of the coin detection sensors 44*a* to 44*d*, the case of a sorting abnormality of the second sorting section 70 being detected from a counting abnormality of the coin detection sensors 74*a* to 74*d*, the case of a sorting abnormality of the third sorting section 80 being detected from a counting abnormality of the coin detection sensors 84*a* to 84*d*, the case of a sorting abnormality of the fourth sorting section 90 being detected from a counting abnormality of the coin detection sensors 94*a* to 94*d*, and the case of a sorting abnormality of the fifth sorting section 100 being detected from a counting abnormality of the coin detection sensors 103*a* and 103*b* shall be described. For each of these cases, at the point in time of detection, the control apparatus 200 stops the paying out of coins from the supply disk 13 and the rotating disk 14 by stopping the supply drive section 201. Along with that, the control apparatus 200 drives the stopper drive section 203 to cause the stopper members 36*a* and 36*b* to project out and thereby stop coins on the upstream side of the stopper members 36*a* and 36*b*. Also, the control apparatus 200 discharges coins between the stopper members 36*a* and 36*b* and the first sorting section 40 from the coin passage 15 at the first sorting section 40, and collects them in the collection bag 55 via the counting chute 50. In addition, the control apparatus 200 causes the sorting of coins on the downstream side of the first sorting section 40 set to be sorted by one of the second sorting section 70, the third sorting section 80, the fourth sorting section 90, and the fifth sorting section 100, respectively. When the coins on the coin passage 15 that are on the downstream side of the stopper members 36*a* and 36*b* disappear, the control apparatus 200 reverses the supply drive section 201 and the conveyance drive section 202 to return the coins between the rotating disk 14 and the stopper members 36*a* and 36*b* to the rotating disk 14. Then, the control apparatus 200 displays on the display section 216 the gist that a counting abnormality has occurred, the presence of collected coins in each of the collection bag 55 and the receiving boxes 76, 86, 96, 105, and a gist urging repeat processing by the country sorting mode. Seeing this, the operator takes out the collected coins from the collection bag 55 and the receiving boxes 76, 86, 96, 105, and after removing the unnecessary ones, supplies them to the supply disk 13 and once again executes processing by the country sorting mode.

(2) The case of one set denomination of one specified country being set, batch processing with boxing at the counting chute 50 being selected, and the batch capture number being set by operation input to the operating section 215.

Upon the start of batch processing in the country sorting mode, the control apparatus 200 drives the gate drive section 205 to put the chute gate 53 into the opened state. Along with that, the control apparatus 200 drives the supply drive section 201 and the conveyance drive section 202. Thereby, the supply disk 13 and the rotating disk 14 rotate, and the conveyor belts 27A to 27I of the coin conveying section 26 rotate. Thereby, coins of the supply disk 13 are transferred to the rotating disk 14, and the coins are paid out one at a time from the rotating disk 14 to the coin passage 15, and conveyed in a row on the coin passage 15.

During the batch processing in the country sorting mode, the control apparatus 200 discharges from the coin passage 15 in the first sorting section 40, by just the set batch capture number, those coins that are identified as normal coins of the one set denomination of the one specified country from the identification result of the identifying section 34, and stores them from the measuring chute 50 to the temporary storage container 60 with the chute gate 53 in the opened state. At that time, the normality/abnormality of the sorting by the first sorting section 40 is confirmed based on the normality/abnormality of the counting of the coin detection sensors 44*a* to 44*d*.

During the batch processing in the country sorting mode, the control apparatus 200 removes from the coin passage 15 at the second sorting section 70 abnormal coins that are identified as different material false coins from the detection result of the material detection sensor 30 in the identifying section 34 and abnormal coins that are identified as different diameter false coins from the detection result of the outer-diameter detection sensor 31 in the identifying section 34, and collects them in the receiving box 76 via the chute 75. At that time, the normality/abnormality of the sorting by the second sorting section 70 is confirmed based on the normality/abnormality of the counting of the coin detection sensors 74*a* to 74*d*.

During the batch processing in the country sorting mode, the control apparatus 200 removes from the coin passage 15 at the third sorting section 80 abnormal coins that are identified as different image false coins from the detection result of the lower-side image detection section 32 in the identifying section 34, abnormal coins that are identified as different image false coins from the detection result of the upper-side image detection section 33, abnormal coins that are identified as reflection-contaminated/damaged genuine coins from the detection result of the reflected-light-quantity detection sensors 35, 35, abnormal coins that are identified as image-contaminated/damaged genuine coins from the detection result of the lower-side image detection section 32, and abnormal coins that are identified as image-contaminated/damaged genuine coins from the detection result of the upper-side image detection section 33, and collects them in the receiving box 86 via the chute 85. At that time, the normality/abnormality of the sorting by the third sorting section 80 is confirmed based on the normality/abnormality of the counting of the coin detection sensors 84*a* to 84*d*.

During the batch processing in the country sorting mode, the control apparatus 200 discharges from the coin passage 15 at the fourth sorting section 90 coins that are normal coins of all denominations other than the one specified country, and collects them in the receiving box 96 via the chute 95. At that time, the normality/abnormality of the sorting by the fourth sorting section 90 is confirmed based on the normality/abnormality of the counting of the coin detection sensors 94*a* to 94*d*.

During the batch processing in the country sorting mode, the control apparatus 200 discharges from the coin passage 15 at the fifth sorting section 100 coins that are normal coins, coins of the one specified country and coins other than the one set denomination, and collects them in the receiving box 105 via the chute 104. At that time, the normality/abnormality of the sorting by the fifth sorting section 100 is confirmed based on the normality/abnormality of the counting of the coin detection sensors 103*a* and 103*b*.

At the timing at which the last coin of the set batch capture number that is the one set denomination of the one specified country can be determined to have passed the stopper members 36*a* and 36*b* based on the detection by the coin detection sensors 37*a* and 37*b*, the control apparatus 200 stops the paying out of coins from the supply disk 13 and the rotating disk 14 by stopping the supply drive section 201. Moreover, the control apparatus 200 drives the stopper drive section 203 to cause the stopper members 36*a* and 36*b* to project out and thereby stop coins on the upstream side of the last coin, and causes the coins on the downstream side of the stopper member 36*a* and 36*b* to be collected to any corresponding among the temporary storage container 60 and the receiving boxes 76, 86, 96, and 105. When the coins on the downstream side of the stopper members 36*a* and 36*b* on the coin passage 15 disappear, the control apparatus 200 reverses the supply drive section 201 and the conveyance drive section 202 to return the coins between the rotating disk 14 and the stopper members 36*a* and 36*b* to the rotating disk 14.

When the collection to the temporary storage container 60 of the coins of the one set denomination of the one specified country, by just the set batch capture number, is completed with no counting abnormalities, and the collection to any corresponding among the receiving boxes 76, 86, 96, and 105 of other coins that occurs during the batch processing in the country sorting mode is completed, the control apparatus 200 collects the coins of the temporary storage container 60 to the collection box 65 via the discharge chute 63. Moreover, the control apparatus 200 stores in association with date data and the like a gist that the all coin processing in the country sorting mode normally ended, the collection number in each of the collection box 65 and the receiving boxes 76, 86, 96, 105, the classification of coins collected in each of the collection box 65 and the receiving boxes 76, 86, 96, 105, and also displays them on the display section 216. The classification of coins collected in each of the collection box 65 and the receiving boxes 76, 86, 96, 105 means that the coins of the collection box 65 are normal coins and coins of the one set denomination of the one specified country, the coins of the receiving box 76 are abnormal coins and different material false coins or different diameter false coins, the coins of the receiving box 86 are abnormal coins and different image false coins, reflection-contaminated/damaged genuine coins or image-contaminated/damaged genuine coins, the coins of the receiving box 96 are normal coins and coins other than the one specified country, and the coins of the receiving box 105 are normal coins and coins other than the one set denomination of the one specified country. By the above process, the batch processing in the country sorting mode ends. Even when there are abnormal coins as stated above, provided there are no counting irregularities, after the start of the batch processing in the country sorting mode and until stopping the next coin after the last coin of the batch capture number, the control apparatus 200 does not drive the stopper drive section 203, and so the stopper members 36*a* and 36*b* are not made to project into the coin passage 15.

During the batch processing in the country sorting mode, the case of a counting abnormality being detected by the identifying section 34, the case of a sorting abnormality of the first sorting section 40 being detected from a counting abnormality of the coin detection sensors 44*a* to 44*d*, the case of a sorting abnormality of the second sorting section 70 being detected from a counting abnormality of the coin detection sensors 74*a* to 74*d*, the case of a sorting abnormality of the third sorting section 80 being detected from a counting abnormality of the coin detection sensors 84*a* to 84*d*, the case of a sorting abnormality of the fourth sorting section 90 being detected from a counting abnormality of the coin detection sensors 94*a* to 94*d*, and the case of a sorting abnormality of the fifth sorting section 100 being detected from a counting abnormality of the coin detection sensors 103*a* and 103*b* shall be described. For each of these cases, at the point in time of detection, the control apparatus 200 stops the paying out of coins from the supply disk 13 and the rotating disk 14 by stopping the supply drive section 201. Along with that, the control apparatus 200 drives the stopper drive section 203 to cause the stopper members 36*a* and 36*b* to project out and thereby stop coins on the upstream side of the stopper members 36*a* and 36*b*. Along with that, the control apparatus 200 discharges coins between the stopper members 36*a* and 36*b* and the first sorting section 40 from the coin passage 15 at the first sorting section 40, and collects them in the temporary storage container 60 via the counting chute 50. In addition, the control apparatus 200 causes the sorting of coins on the downstream side of the first sorting section 40 set to be sorted by one of the second sorting section 70, the third sorting section 80, the fourth sorting section 90, and the fifth sorting section 100, respectively. When the coins on the coin passage 15 that are on the downstream side of the stopper members 36*a* and 36*b* disappear, the control apparatus 200 collects the coins of the temporary storage container 60 to the return box 64, and also reverses the supply drive section 201 and the conveyance drive section 202 to return the coins between the rotating disk 14 and the stopper members 36*a* and 36*b* to the rotating disk 14. Then, the control apparatus 200 displays on the display section 216 the gist that a counting abnormality has occurred, the presence of collected coins in each of the return box 64 and the receiving boxes 76, 86, 96, 105, and a gist urging repeat processing by the country sorting mode. Seeing this, the operator takes out the collected coins from the return box 64 and the receiving boxes 76, 86, 96, 105, and after removing the unnecessary ones, supplies them to the supply disk 13 and once again executes processing by the country sorting mode.

In the above country sorting mode, three sorting sections, namely, the first sorting section 40, the fourth sorting section 90 and the fifth sorting section 100 constitute a discharging section that discharges normal coins that are identified as normal by the identifying section 34 from the coin passage 15. Two sorting sections, namely, the second sorting section 70 and the third sorting section 80 constitute a removing section that removes abnormal coins that are identified as abnormal by the identifying section 34 from the coin passage 15. The first sorting section 40 that is one of the first sorting section 40, the fourth sorting section 90 and the fifth sorting section 100 constitutes a specified discharging section that discharges coins that are normal coins of a specified denomination, while other sorting section, namely, the fifth sorting section 100 constitute an unspecified discharging section that discharges coins that are normal coins other than the coins of the specified denomination. In addition, subsequent to the first sorting section 40, the counting chute 50 for bagging coins that are normal coins of the specified denomination and the discharge chute 63 for boxing coins that are normal coins of the specified denomination also constitute an unspecified discharging section. The control apparatus 200, in the case of removing an abnormal coin, performs removal by distribution to the two sorting sections of the second sorting section 70 and the third sorting section 80, in accordance with the identification factor of the abnormal coin.

In the above manner, in the operating section 215, the three operation modes of the identification mode, the counting mode, and the country sorting mode are selectable. The control apparatus 200 operates in accordance with the operation mode that is selected and set by the operating section 215 In the identification mode, the control apparatus 200 selects and sets the identification factor of abnormal coins to be removed by distribution to the three sorting sections, namely, the second sorting section 70, the third sorting section 80 and the fourth sorting section 90, and causes the identification factor of abnormal coins to be displayed on the display section 216 at each of the second sorting section 70, the third sorting section 80 and the fourth sorting section 90. In the counting mode, the control apparatus 200 selects and sets the identification factor of abnormal coins to be removed by distribution to the two sorting sections, namely, the second sorting section 70 and the fourth sorting section 90, and causes the identification factor of abnormal coins to be displayed on the display section 216 at each of the second sorting section 70 and the fourth sorting section 90. In the country sorting mode, the control apparatus 200 selects and sets the identification factor of abnormal coins to be removed by distribution to the two sorting sections, namely, the second sorting section 70 and the third sorting section 80, and causes the identification factor of abnormal coins to be displayed on the display section 216 at each of the second sorting section 70 and the third sorting section 80.

The coin processing apparatus of the present embodiment described above has three sorting sections, namely, the second sorting section 70, the third sorting section 80 and the fourth sorting section 90 that remove from the coin passage 15 abnormal coins that are identified as abnormal by the identifying section 34. With this constitution, according to the coin processing apparatus of the present embodiment, in the identification mode, in the case of removing an abnormal coin, the control apparatus 200, in accordance with the identification factor of the abnormal coins, removes by distribution to the three sorting sections of the second sorting section 70, the third sorting section 80 and the fourth sorting section 90. Therefore, it is possible to remove abnormal coins in accordance with the identification factor by distribution to the separate second sorting section 70, the third sorting section 80, and the fourth sorting section 90.

Also, the coin processing apparatus of the present embodiment has two sorting sections, namely, the second sorting section 70 and the fourth sorting section 90 that remove from the coin passage 15 abnormal coins that are identified as abnormal by the identifying section 34. With this constitution, according to the coin processing apparatus of the present embodiment, in the counting mode, the control apparatus 200, in accordance with the identification factor of the abnormal coins, removes the coins by distribution to the two sorting sections of the second sorting section 70 and the fourth sorting section 90. Therefore, it is possible to remove abnormal coins in accordance with the identification factor by distribution to the separate second sorting section 70 and the fourth sorting section 90.

Also, the coin processing apparatus of the present embodiment has two sorting sections, that is the second sorting section 70 and the third sorting section 80 that remove from the coin passage 15 abnormal coins that are identified as abnormal by the identifying section 34. With this constitution, according to the coin processing apparatus of the present embodiment, in the country sorting mode, in the case of removing abnormal coins, the control apparatus 200, in accordance with the identification factor of the abnormal coins, removes them by distribution to the two sorting sections of the second sorting section 70 and the third sorting section 80. Therefore, it is possible to remove abnormal coins in accordance with the identification factor by distribution to the separate second sorting section 70 and the third sorting section 80.

By this type of distribution removal, it is possible to specify an abnormal coin and clarify the identification factor thereof even without causing the abnormal coin to stop. Accordingly, it is possible to specify an abnormal coin and clarify the identification factor thereof and prevent a drop in the processing efficiency even in the case of identifying a group of coins that includes comparatively many abnormal coins.

Also, in the identification mode and the country sorting mode, the first sorting section 40 that is one of the first sorting section 40 and the fifth sorting section 100 is made a specified discharging section that discharges coins that are normal coins of a specified denomination, while the fifth discharging section 100, which is the other of the two, is made an unspecified discharging section that discharges coins that are normal coins other than the specified denomination. For this reason, it is possible to separate coins that are normal coins and of a specified denomination and coins that are normal coins and other than the specified denomination and discharge them.

Also, the specified discharging section has a counting chute 50 for bagging coins that are normal coins and of a specified denomination, and a discharge chute 63 for boxing coins that are normal coins and of a specified denomination. For this reason, it is possible to discharge coins that are normal coins and of a specified denomination in the state of one of bagging or boxing being selected.

Also, the control apparatus 200, depending on the operation mode that is selected and set by the operating section 215, selects and sets the identification factor of the abnormal coin to be removed by distribution to each of the three sorting sections, namely, the second sorting section 70, the third sorting section 80 and the fourth sorting section 90 in the identification mode, to each of the two sorting sections, namely, the second sorting section 70 and the fourth sorting section 90 in the counting mode, and to each of the two sorting sections, namely, the second sorting section 70 and the third sorting section 80 in the country sorting mode. For this reason, the identification for each distribution removal is automatically decided by the mode selection.

Also, the identification factor of an abnormal coin is displayed on the display section 216 for each of the three sorting sections, namely, the second sorting section 70, the third sorting section 80 and the fourth sorting section 90 in the identification mode, each of the two sorting sections, namely, the second sorting section 70 and the fourth sorting section 90 in the counting mode, and each of the two sorting sections, namely, the second sorting section 70 and the third sorting section 80 in the country sorting mode. For that reason, it is possible to readily allow recognition of the correspondence relationship between the sorting section and the identification factor of an abnormal coin.

In the coin processing apparatus of the present embodiment, normal coins that are identified as normal by the identifying section 34 are discharged from the coin passage 15 by two sorting section, namely, the first sorting section 40 and the fifth sorting section 100 in the identification mode, by one sorting section, namely, first sorting section 40 in the counting mode, and by three sorting section, namely, the first sorting section 40, the fourth sorting section 90, and the fifth sorting section 100 in the country sorting mode, but it is not limited thereto. There may be at least one sorting section that discharges normal coins from the coin passage 15, and there may also be four or more.

Abnormal coins that are identified as abnormal by the identifying section 34 are discharged from the coin passage 15 by three sorting sections, namely, the second sorting section 70, the third sorting section 80, and the fourth sorting section 90 in the identification mode, by two sorting sections, namely, the second sorting section 70 and the fourth sorting section 90 in the counting mode, and by two sorting sections, namely, the second sorting section 70 and the third sorting section 80 in the country sorting mode, but it is not limited thereto. There may be at least two sorting sections that discharge abnormal coins from the coin passage 15, and there may also be four or more.

Coins that are normal coins and of the specified denomination are discharged from the coin passage 15 by one that is selected from the counting chute 50 for bagging and the discharge chute 63 for boxing. However, the constitution is not limited thereto. Only one of the counting chute 50 and the discharge chute 63 may be provided.

In the operating section 215, the three operation modes of the identification mode, the counting mode and the country sorting mode are selectable, and the control apparatus 200 selects and sets the identification factor of an abnormal coin to be removed by distribution depending on the operation mode that is selected and set, but is not limited thereto. It is possible that at least two operation modes are selectable, and the control apparatus 200 is made to select and set the identification factor of an abnormal coin to be removed by distribution depending on the operation mode that is selected and set.

In the operating section (identification factor setting section) 215, the identification factor for removing by distribution may be made to be selected and set for each removing section of the second sorting section 70, the third sorting section 80, and the fourth sorting section 90. In that case, the control apparatus 200, in the case of selecting and setting the identification factor for one removing section by the operating section 215, may limit the other removing sections so as not to overlap with the identification factor that is already selected and set. By configuring in this manner, it is possible to arbitrarily set the identification factor for each removing section. Moreover, in the case of selecting and setting the identification factor for one removing section by the operating section 215, since the control apparatus 200 performs restriction so that the identification factor for the one removing section does not overlap with the identification factor that is selected and set for the other removing section, it is possible to prevent the same identification factor being redundantly set for a plurality of removing sections.

Instead of guiding coins from the chutes 75, 85, 95, 104 to the receiving boxes 76, 86, 96, 105, at least any one of the receiving boxes 76, 86, 96, 105 may be made a collection bag.

Counting abnormalities include a near feed in which a plurality of coins are conveyed in close proximity, an overrun in which a coin overruns without being able to drop for sorting, and a one-sided defect in which a coin moves at a position that cannot be detected by a sensor. Since these are not phenomena that frequently occur, when a counting abnormality has happened, a coin of counting abnormality is guided to the counting chute 50 or the discharge chute 63 which guides a normal coin and made to drop therein, and then processing is performed again with the normal coins that had been counted until then. However, in order to improve the processing efficiency during counting abnormalities, by providing a separate sorting section on the upstream side of the first sorting section 40 and a separate chute to the return box 64, coins of counting abnormalities that occurred in the identifying section 34 during all of the modes may be directly returned to the return box 64 by this sorting section and this chute.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A coin processing apparatus comprising:

a coin conveying section that conveys coins on a coin passage;

an identifying section that identifies coins on the coin passage;

at least one discharging section that discharges normal coins that are identified as normal by the identifying section from the coin passage;

at least first and second removing sections that remove abnormal coins that are identified as abnormal by the identifying section from the coin passage;

a control section that distributes abnormal coins to either one of the first and second removing sections in order to remove the abnormal coins, in accordance with identification factors of the abnormal coins; and an identification factor setting section that selects and sets the identification factor of the abnormal coins at each of the first and second removing sections, wherein the control section limits an identification factor to be select and set for the first removing section by the identification factor setting section so as not to overlap with an identification factor that has been selected and set for the second removing section.

2. The coin processing apparatus according to claim 1, wherein the discharging section includes at least first and second discharging sections, and the first discharging section is a specified discharging section that discharges coins that are normal coins and of a specified denomination, and the second discharging section is an unspecified discharging section that discharges coins that are normal coins and other than the coins of the specified denomination.

3. The coin processing apparatus according to claim 2, wherein the specified discharging section includes at least either one of a counting chute for bagging coins that are normal coins and of the specified denomination, and a discharge chute for boxing coins that are normal coins and of the specified denomination.

4. The coin processing apparatus according to claim 3, further comprising:

a mode setting section that selects either one of at least two operation modes, wherein the control section selects and sets the identification factors of the abnormal coins at the first and second removing sections, in accordance with the operation mode selected by the mode setting section.

5. The coin processing apparatus according to claim 3, further comprising:

a display section that displays the identification factors for the abnormal coins for each of the first and second removing sections.

6. The coin processing apparatus according to claim 2, further comprising:

a mode setting section that selects either one of at least two operation modes, wherein the control section selects and sets the identification factors of the abnormal coins at the first and second removing sections, in accordance with the operation mode selected by the mode setting section.

7. The coin processing apparatus according to claim 2, further comprising:

a display section that displays the identification factors for the abnormal coins for each of the first and second removing sections.

8. The coin processing apparatus according to claim 1, further comprising:

a mode setting section that selects either one of at least two operation modes, wherein the control section selects and sets the identification factors of the abnormal coins at the first and second removing sections, in accordance with the operation mode selected by the mode setting section.

9. The coin processing apparatus according to claim 8, further comprising:

a display section that displays the identification factors for the abnormal coins for each of the first and second removing sections.

10. The coin processing apparatus according to claim 1, further comprising:

a display section that displays the identification factors for the abnormal coins for each of the first and second removing sections.

11. A coin processing apparatus comprising:

a coin conveying section that conveys coins on a coin passage;

an identifying section that identifies coins on the coin passage;

at least one discharging section that discharges normal coins that are identified as normal by the identifying section from the coin passage;

at least first and second removing sections that remove abnormal coins that are identified as abnormal by the identifying section from the coin passage;

a control section that distributes abnormal coins to either one of the first and second removing sections in order to remove the abnormal coins, in accordance with identification factors of the abnormal coins; and a display section that displays the identification factors for the abnormal coins for each of the first and second removing sections.

12. The coin processing apparatus according to claim 11, wherein the discharging section includes at least first and second discharging sections, and the first discharging section is a specified discharging section that discharges coins that are normal coins and of a specified denomination, and the second discharging section is an unspecified discharging section that discharges coins that are normal coins and other than the coins of the specified denomination.

13. The coin processing apparatus according to claim 12, wherein the specified discharging section includes at least either one of a counting chute for bagging coins that are normal coins and of the specified denomination, and a discharge chute for boxing coins that are normal coins and of the specified denomination.

14. The coin processing apparatus according to claim 11, further comprising:

a mode setting section that selects either one of at least two operation modes, wherein the control section selects and sets the identification factors of the abnormal coins at the first and second distribution sections, in accordance with the operation mode selected by the mode setting section.

* * * * *